US011512427B2

(12) United States Patent
Jolly et al.

(10) Patent No.: US 11,512,427 B2
(45) Date of Patent: Nov. 29, 2022

(54) SELECTIVELY DEPOLYMERIZING CELLULOSIC MATERIALS FOR USE AS THERMAL AND ACOUSTIC INSULATORS

(71) Applicant: DTE Materials Incorporated, San Luis Obispo, CA (US)

(72) Inventors: Tanner Jolly, Fresno, CA (US); Jose Urizar, San Luis Obispo, CA (US)

(73) Assignee: DTE Materials Incorporated, Fresno, CA (US)

( * ) Notice: Subject to any disclaimer, the term of this patent is extended or adjusted under 35 U.S.C. 154(b) by 70 days.

(21) Appl. No.: 16/812,271

(22) Filed: Mar. 7, 2020

(65) Prior Publication Data

US 2020/0263356 A1 Aug. 20, 2020

Related U.S. Application Data

(63) Continuation of application No. PCT/US2018/049934, filed on Sep. 7, 2018.
(Continued)

(51) Int. Cl.
*D21C 9/10* (2006.01)
*D21C 9/08* (2006.01)
(Continued)

(52) U.S. Cl.
CPC ..... *D21C 9/083* (2013.01); *B27K 3/0221* (2013.01); *B27K 3/163* (2013.01); *E04B 1/88* (2013.01);
(Continued)

(58) Field of Classification Search
CPC ..... D21C 9/083
(Continued)

(56) References Cited

U.S. PATENT DOCUMENTS 2,064,965 A 12/1936 Ernst et al.
3,652,385 A 3/1972 Noreus et al.
(Continued)

FOREIGN PATENT DOCUMENTS

CA 3006341 A1 6/2017
EP 2118362 A1 11/2009
(Continued)

OTHER PUBLICATIONS

EP18853637.9 Extended European Search Report dated Jun. 11, 2021.
(Continued)

*Primary Examiner* — Jacob T Minskey
(74) *Attorney, Agent, or Firm* — Wilson Sonsini Goodrich & Rosati

(57) ABSTRACT

The present invention relates to the creation of thermally insulating materials derived from cellulosic materials by selectively depolymerizing the materials anatomy. Cellulosic materials may be comprised of three main biopolymers: lignin, hemicellulose, and cellulose. The present invention relates to the chemical and physical removal of lignin and hemicellulose, while leaving the cellulose unaltered to induce increased porosity within the material and the material's macrostructure matrix for use as thermal and acoustic insulation. The increased porosity will be due to the creation of closed cell voids within the cellulosic matrix. These voids will increase the thermal and acoustic insulating performance of the cellulosic materials. The selective removal of secondary biopolymers from cellulosic materials allow for isolation of other value added products that can be regenerated through fewer reactions/steps. This is a novel advantage over other similar processes that dissolve cellulose completely, making it harder to extract and isolate secondary off-stream products.

23 Claims, 12 Drawing Sheets

Related U.S. Application Data

(60) Provisional application No. 62/676,812, filed on May 25, 2018, provisional application No. 62/555,899, filed on Sep. 8, 2017.

(51) Int. Cl.

| | |
|---|---|
| ***B27K 3/02*** | (2006.01) |
| ***B27K 3/16*** | (2006.01) |
| ***E04B 1/88*** | (2006.01) |
| ***E04B 1/94*** | (2006.01) |

(52) U.S. Cl.
CPC ..... *E04B 1/94* (2013.01); *B27K 2200/10* (2013.01); *B27K 2240/10* (2013.01); *B27K 2240/30* (2013.01); *E04B 2103/04* (2013.01)

(58) Field of Classification Search
USPC ..... 162/70
See application file for complete search history.

(56) References Cited

U.S. PATENT DOCUMENTS

| | | | | |
|---|---|---|---|---|
| 3,691,008 | A | 9/1972 | Worster et al. | |
| 4,045,257 | A | 8/1977 | Butter et al. | |
| 4,087,318 | A | 5/1978 | Samuelson et al. | |
| 4,089,737 | A | 5/1978 | Nagano et al. | |
| 4,650,127 | A | 3/1987 | Radwanski et al. | |
| 5,494,748 | A | 2/1996 | Spehner | |
| 5,755,926 | A | 5/1998 | Hankins et al. | |
| 5,910,367 | A | 6/1999 | Kean et al. | |
| 6,251,476 | B1 | 6/2001 | Boyer et al. | |
| 6,300,259 | B1 | 10/2001 | Westland et al. | |
| 6,676,745 | B2 | 1/2004 | Merkley et al. | |
| 6,770,168 | B1 | 8/2004 | Stigsson | |
| 7,790,069 | B2 | 9/2010 | Kiuchi et al. | |
| 8,043,384 | B2 | 10/2011 | Gagnon et al. | |
| 8,044,120 | B2 | 10/2011 | D'Andola et al. | |
| 8,101,239 | B1 | 1/2012 | Kean et al. | |
| 8,118,177 | B2 | 2/2012 | Drapela et al. | |
| 8,322,111 | B2 | 12/2012 | Near et al. | |
| 8,388,807 | B2 | 3/2013 | Sealey et al. | |
| 8,454,795 | B1 | 6/2013 | Henderson et al. | |
| 8,663,427 | B2 | 3/2014 | Sealey et al. | |
| 8,685,206 | B2 | 4/2014 | Sealey et al. | |
| 8,795,470 | B2 | 8/2014 | Henderson et al. | |
| 8,871,053 | B2 | 10/2014 | Sealey et al. | |
| 8,871,058 | B2 | 10/2014 | Sealey et al. | |
| 8,945,678 | B2 | 2/2015 | Burgess et al. | |
| 8,973,762 | B2 | 3/2015 | Sellars et al. | |
| 2003/0064230 | A1* | 4/2003 | Liu | B27N 9/00 428/425.1 |
| 2007/0116991 | A1 | 5/2007 | Balthes et al. | |
| 2007/0190872 | A1 | 8/2007 | Weber et al. | |
| 2007/0209307 | A1 | 9/2007 | Andersen | |
| 2008/0145637 | A1 | 6/2008 | Frank | |
| 2008/0190321 | A1 | 8/2008 | Maase et al. | |
| 2012/0255695 | A1 | 10/2012 | Sealey et al. | |
| 2017/0021208 | A1* | 1/2017 | Dor-El | D04B 21/14 |
| 2017/0239836 | A1 | 8/2017 | Zhan et al. | |
| 2018/0370071 | A1* | 12/2018 | Boitouzet | B27K 3/0221 |

FOREIGN PATENT DOCUMENTS

| | | | |
|---|---|---|---|
| WO | WO-2005017001 | A1 | 2/2005 |
| WO | WO-2006116126 | A2 | 11/2006 |
| WO | WO-2008095252 | A1 | 8/2008 |
| WO | WO-2008098032 | A2 | 8/2008 |
| WO | WO-2008098037 | A2 | 8/2008 |
| WO | WO-2011114004 | A1 | 9/2011 |
| WO | WO-2012032514 | A1 | 3/2012 |
| WO | WO-2013000074 | A1 | 1/2013 |
| WO | WO-2017066728 | A1 | 4/2017 |
| WO | WO-2019051212 | A1 | 3/2019 |

OTHER PUBLICATIONS

Fu, et al., Nanostructured Wood Hybrids for Fire-Retardancy Prepared by Clay Impregnation into the Cell Wall, ACS Appl. Mater. Interfaces 2017, 9, 36154-36163. DOI: 10.1021/acsami.7b10008.

Bamdad et al., A review on common adsorbents for acid gases removal: focus on biochar; Renewable and Sustainable Energy Reviews (2017), http://dx.doi/10.1016/j.rser.2017.05.261.

Bendahou et al. Nano-fibrillated cellulose zeolites based new hybrid composites aerogels with super thermal insulating properties, Industrial Crops and Products, vol. 65 (2015).

Cox et al., Catalytic degradation of lignin model compounds in acidic imidazolium based ionic liquids: Hammett acidity and anion effects; Polymer Degradation and Stability 96 (2011) 426-431.

Koutinas et al., Nano-tubular cellulose bioprocess technology development, PloS One 7(4) pp. 1-9 (2012).

Li et al., Optically transparent wood from a nanoporous cellulosic template: combining functional and structural performance, Biomacromolecules, 17 pp. 1358-1364 (2016).

PCT/US2018/049934 Search Report & Written Opinion dated Oct. 29, 2018.

Rosa et al., Chlorine-free extraction of cellulose from rice husk and whisker isolation. Carbohydrate Polymers, 87 pp. 1131-1138 (2012).

Shea et al., Evaluation of the thermal performance of an innovative pre-fabricated natural plant fibre building system. Building Services Engineering Research and Technology, 34(4) pp. 369-380 (2012).

* cited by examiner

CINa02 H+ Delig Hemp - File: CINaO2 H+ Delig Hemp.raw - Type: 2Th/Th locked - Start: 10,000 ° - End: 60,000 ° - Step: 0,050 ° - Step time: 0.6 s - Temp.: 25 °C (Room) - Time started: 1489520000 s - 2-T
Operations: Import Control Blended Hemp Hurd - File: Control Blended Hemp Hurd.raw - Type: 2Th/Th locked - Start: 10,000 ° - End: 60,000 ° - Step: 0,050 ° - Step time: 0.6 s - Temp.: 25 °C (Room) - Time started: 14940117
Operations: Import

800

810

820

SELECTIVELY DEPOLYMERIZING CELLULOSIC MATERIALS FOR USE AS THERMAL AND ACOUSTIC INSULATORS

CROSS-REFERENCE

This application is a continuation of PCT Application No. PCT/US2018/049934, filed Sep. 7, 2018, which claims the benefit of U.S. Provisional Application 62/555,899 filed on Sep. 8, 2017, and U.S. Provisional Application No. 62/676,812 filed on May 25, 2018, each of which is incorporated in its entirety herein by reference.

BACKGROUND

Cellulosic materials are widely used as building insulation materials. The cellulosic materials are often broken down into pieces and are inserted into (e.g., blown in) cavities of roofs, walls, or floors to provide thermal and acoustic insulation. Compared to batts (e.g., a sheet of cotton or wool), the small pieces of the cellulosic materials can more effectively fill nooks and crannies of building structures for effective insulation. The cellulosic materials include recycled products such as newspaper, cardboards, sawdust, and denims. The use of recycled products reduces the overall cost of making and using such building insulation materials. Additionally, fire retardants are often added to the cellulosic materials to provide increased flame resistivity and reduced fungal and bacterial infestation. Ammonium sulfate and boric acid have been commonly used as fire retardants for the building insulation materials.

SUMMARY

Recognized herein are various problems with current cellulosic materials as building insulation materials. With increased environmental awareness and increased dependency on electronic communications, a supply of recycled cellulosic materials (e.g., newspaper, cardboards, sawdust, and denims) can be limited. In addition, current methods of adding fire retardants into cellulosic materials may not provide sufficient physical integrations between the fire retardants and the cellulosic materials, thereby realizing only limited insulating properties.

The present disclosure provides an alternative source of cellulosic materials and improved methods of treating the cellulosic materials to enhance thermal and acoustic insulating properties. The cellulosic materials can be derived from plants, including bast fibers, leaf, seed, fruit, grass, and wood. Examples of such plants may be hemp, jute, sisal, and bamboo. The systems and methods disclosed herein may provide chemically treating the cellulosic materials to remove at least a portion of non-cellulosic materials (e.g., lignin and hemicellulose) from the cellulosic materials, thereby creating one or more pores within the matrix of the cellulosic materials. The one or more pores may be filled or capped with fire retardants to improve thermal and acoustic insulating properties.

An aspect of the present disclosure provides a composite building material, comprising: (a) a cellulosic material, wherein the cellulosic material (i) is at least partially delignified, (ii) maintains at least a portion of cellulose crystal structure, and (iii) comprises a plurality of pores; and (b) a fire retardant distributed in and/or on the cellulosic material, wherein one or more of the plurality of pores are covered by the fire retardant.

In some embodiments, a thermal resistivity (RSI-value) of the composite building material ranges between about 1 to 8 $m^2 \cdot K/W$.

In some embodiments, the cellulosic material is a natural fiber, which the natural fiber comprises a bast fiber, leaf, seed, fruit, grass, and wood.

In some embodiments, a source of the natural fiber is selected group the group consisting of flax, hemp, kenaf, jute, ramie, isora, nettle, ananas, sisal, abaca, curua, cabuya, palm, opuntia, jipijapa, yucca, cotton, coir, kapok, soya, poplar, calotropis, luffa, bamboo, totora, hardwood, softwood, and any combination thereof.

In some embodiments, the cellulosic material is a recycled cellulose product.

In some embodiments, the cellulosic material that is at least partially delignified has a Kappa number that is reduced as compared to the cellulosic material without any delignification.

In some embodiments, the cellulosic material that is at least partially delignified is prepared by depolymerization of at least a portion of lignin, hemicellulose, and/or pectin.

In some embodiments, the cellulosic material that is at least partially delignified is characterized by at least about 0.01% removal of lignin.

In some embodiments, the cellulosic material maintains at least about 50% of the cellulose crystal structure.

In some embodiments, a degree of crystallinity of the at least the portion of the cellulose crystal structure is assessed by X-ray diffraction (XRD), differential scanning calorimetry (DSC), and thermogravimetric analysis (TGA).

In some embodiments, a presence of the plurality of pores of the cellulosic material is assessed by scanning electron microscopy (SEM).

In some embodiments, the plurality of pores of the cellulosic material are nanopores and/or micropores.

In some embodiments, the plurality of pores of the cellulosic material have a cross-sectional width in a range between about 1 nanometer (nm) to about 1 millimeter (mm).

In some embodiments, the cellulosic material is subjected to fiberization prior to and/or subsequent to delignification, and wherein the fiberization creates one or more macropores that have a cross-sectional width greater than 1 mm.

In some embodiments, a density of the cellulosic material subjected to the fiberization is between about 2.5 to 3.7 $lb/ft^3$.

In some embodiments, the fire retardant increases fire resistivity, fungal and bacterial infestation, and/or thermal resistivity of the cellulosic material.

In some embodiments, the fire retardant covers about 10 to 100% of the one or more pores of the cellulosic material, thereby creating one or more closed cells.

In some embodiments, the fire retardant is present in an amount between about 5 to 70% by weight.

In some embodiments, the fire retardant is selected from the group consisting of borate derivatives, magnesium oxides, oxides, organics, and acrylates aluminum ammonium sulfate, magnesium silicate, aluminum hydroxide, calcium magnesium carbonate, hydrated magnesium carbonate hydroxide, potassium aluminum sulfate, calcium carbonate, sodium carbonate, talc, clay, and silica based aerogels.

In some embodiments, a viscosity of the fire retardant is between about 10 centipoise (cP) to about 10,000 cP.

In some embodiments, the fire retardant is added to the cellulosic material by using a mechanical pneumatic bonding process.

In some embodiments, the composite building material further comprises a dye to change an apparent color of the composite building material.

Another aspect of the present disclosure provides a method of making a composite building material, comprising: (a) subjecting a cellulosic material to a pretreatment such that the cellulosic material (i) is at least partially delignified, (ii) maintains at least a portion of cellulose crystal structure, and (iii) comprises a plurality of pores; and (b) adding a fire retardant to the cellulosic material such that the fire retardant is distributed in and/or on the cellulosic material, wherein one or more of the plurality of pores are covered by the fire retardant.

In some embodiments, a thermal conductivity of the composite building material ranges between about 2 to 20 $m^2 \cdot K/W$.

In some embodiments, the cellulosic material is a natural fiber, which the natural fiber comprises a bast, leaf, seed, fruit, grass, and wood.

In some embodiments, a source of the natural fiber is selected group the group consisting of flax, hemp, kenaf, jute, ramie, isora, nettle, ananas, sisal, abaca, curua, cabuya, palm, opuntia, jipijapa, yucca, cotton, coir, kapok, soya, poplar, calotropis, luffa, bamboo, totora, hardwood, softwood, and any combination thereof.

In some embodiments, the cellulosic material is a recycled cellulose product.

In some embodiments, the cellulosic material that is at least partially delignified has a Kappa number that is reduced as compared to the cellulosic material without any delignification.

In some embodiments, the pretreatment comprises selectively depolymerizing lignin, hemicellulose, and/or pectin of the cellulosic material.

In some embodiments, the cellulosic material maintains at least about 50% of the cellulose crystal structure.

In some embodiments, the method further comprises assessing a degree of crystallinity of the at least the portion of the cellulose crystal structure by X-ray diffraction (XRD), differential scanning calorimetry (DSC), and thermogravimetric analysis (TGA).

In some embodiments, the method further comprises assessing a presence of the plurality of pores of the cellulosic material is assessed by scanning electron microscopy (SEM).

In some embodiments, the plurality of pores of the cellulosic material are nanopores, and/or micropores.

In some embodiments, the plurality of pores of the cellulosic material have a cross-sectional width in a range between about 1 nanometer (nm) to about 1 millimeter (mm).

In some embodiments, the method further comprises subjecting the cellulosic material to fiberization prior to and/or subsequent to delignification, wherein the fiberization creates one or more macropores that have a cross-sectional width greater than 1 mm.

In some embodiments, a density of the cellulosic material subjected to the fiberization is between about 2.5 to 3.7 $lb/ft^3$.

In some embodiments, the fire retardant increases fire resistivity, fungal and bacterial infestation, and/or thermal resistivity of the cellulosic material.

In some embodiments, the fire retardant covers about 10 to 100% of the one or more pores of the cellulosic material, thereby creating one or more closed cells.

In some embodiments, the fire retardant is present in an amount between about 5 to 70% by weight.

In some embodiments, the fire retardant is selected from the group consisting of borate derivatives, magnesium oxides, oxides, organics, and acrylates aluminum ammonium sulfate, magnesium silicate, aluminum hydroxide, calcium magnesium carbonate, hydrated magnesium carbonate hydroxide, potassium aluminum sulfate, calcium carbonate, sodium carbonate, talc, clay, and silica based aerogels.

In some embodiments, a viscosity of the fire retardant is between about 10 cP to about 10,000 cP.

In some embodiments, the fire retardant is added to the cellulosic material by using a mechanical pneumatic bonding process.

In some embodiments, the pretreatment comprises wetting the cellulosic material with a first liquid prior to adding the fire retardant, wherein the first liquid is introduced by spraying and/or steaming.

In some embodiments, the fire retardant is dispersed in a second liquid, further comprising adding the second liquid including the fire retardant to the cellulosic material.

In some embodiments, the method further comprises subjecting the composite building material to steam, wherein the steam (i) is wet, dry, or superheated and (ii) wets at least a portion of the fire retardant that is distributed in and/or on the cellulosic material.

In some embodiments, the method further comprises subjecting the composite building material to heat.

In some embodiments, the method further comprises adding a dye to change an apparent color of the composite building material.

In some embodiments, the method further comprises blowing in the composite building material to one or more cavities of a roof, wall, and/or floor for insulation.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings (also "Figure" and "FIG." herein) of which:

DETAILED DESCRIPTION

Figure 1:
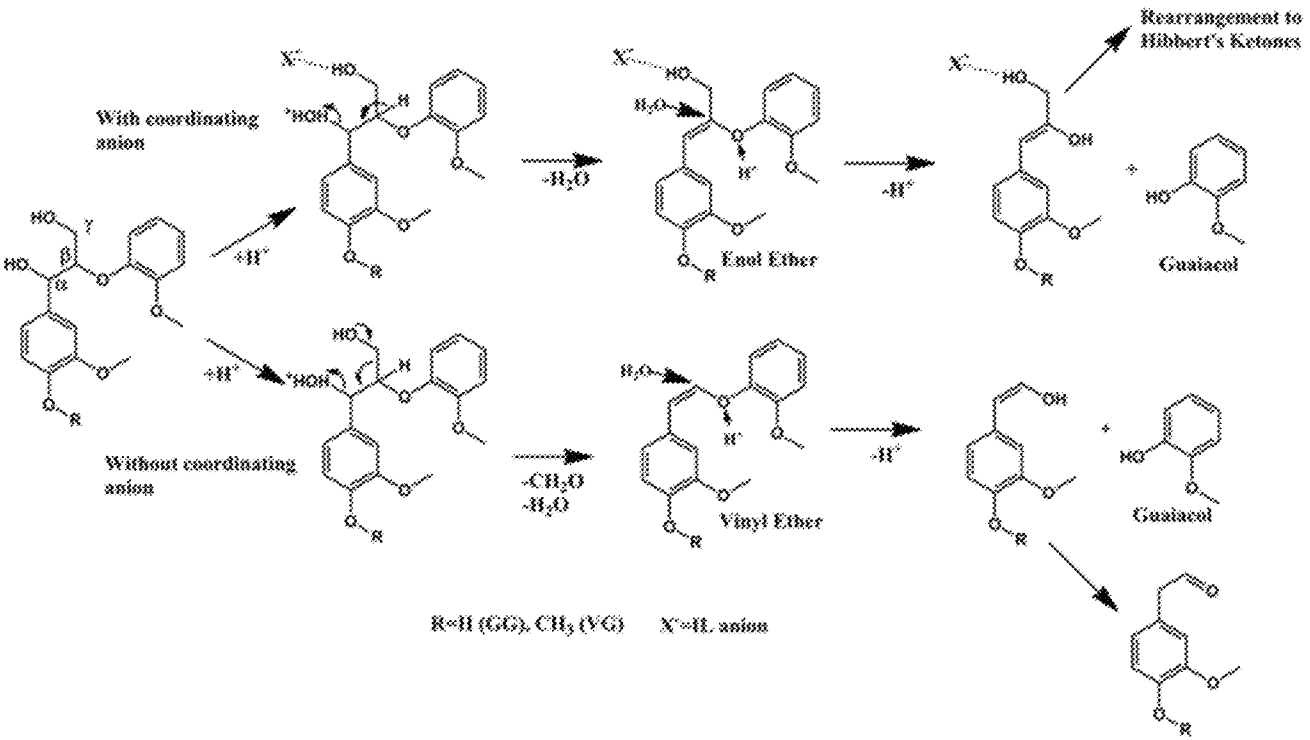
FIG. 1 shows a chemical process of delignification.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

In an aspect, the present disclosure provides a composite building material. The composite building material may include a cellulosic material. The cellulosic material may be (i) at least partially delignified, (ii) maintains at least a portion of cellulose crystal structure, and (iii) comprises a plurality of pores. The composite building material may also include a fire retardant distributed in and/or on the cellulosic material. The one or more of the plurality of pores are covered by said fire retardant. The composite building material may be used as thermal and acoustic insulators.

The present invention is directed to methods for converting a cellulosic material to be used as thermal insulators.

The cellulosic material may be or derived from a natural fiber. Examples of the natural fiber include a bast, leaf, seed, fruit, grass, wood, and any combination thereof. Examples of a source of the natural fiber include flax, hemp, kenaf, jute, ramie, isora, nettle, ananas, sisal, abaca, curua, cabuya, palm, opuntia, jipijapa, yucca, cotton, coir, kapok, soya, poplar, calotropis, luffa, bamboo, totora, hardwood, softwood, and any combination thereof.

The removal of lignin and hemicellulose can be conducted through physical or chemical means.

Physical removal can include, but is not limited to, steam explosion, die extrusion, and mechanical/alkaline fractionation. The mechanical removal may be in the presence or absence of solvents.

The chemical selective depolymerization of lignocellulosic biomass, while maintaining cellulose crystal structure, can be achieved using the following groups/techniques of solvents: Kraft process, ionic liquids, sodium hydroxide, sodium sulfide, sulfates, chlorite, hypochlorite, with or without an acid catalyst, oxidizers, reducers, nucleophiles, electrophiles, organics, inorganics, halogens, noble gasses, metals, transition metals, acids, bases, neutrals, radicals, and in polar solvents or nonpolar solvents. Crystal structure refers to the ordered arrangement of atoms or molecules in solid materials, and can also be described as the lattice structure. In the present invention, cellulose molecules are unaltered which means the unit cells remain in the material with its original orientation and structure. In prior art, chemical treatments are aimed at depolymerizing cellulose, hemicellulose, and lignin. The present invention takes an alternative approach by selectively depolymerizing hemicellulose and lignin without changing the orientation of the cellulose which acts as the structural backbone for the plant.

An ionic liquid can be solid or liquid at room temperature, and is based on weak ionic attractions between a cation and an anion. The cation is frequently bulky in size which distributes the positive charge across a larger electron cloud. The anion is generally smaller in the number of molecules which makes the negative concentrated over fewer electronegative atoms. The disproportion in size between the anion and cation leads to weak positive and negative electrochemical attraction. This is where the term ionic liquid is derived because strong ionic attractions usually produce solid materials, but the distribution of charges allows for liquids to be present at room temperature or at slightly elevated temperatures between 20 degrees Celsius (° C.) and 50° C. Liquid phase solvent is essential for the invention for saturation of the lignocellulosic material as solids would not provide the appropriate mechanisms to effectively and selectively depolymerize the lignin and hemicellulose away from the cellulose which are bound to cellulose through strong hydrogen bonds. A hydrogen bond is a strong chemical attraction between the lone pair of electrons present on oxygen, nitrogen, or fluorine and a hydrogen atom. The ionic liquids comprise organic cations created by derivatizing one or more compounds to include substituents, such as alkyl, alkenyl, alkynyl, alkoxy, alkenoxy, alkynoxy, a variety of aromatics, such as (substituted or unsubstituted) phenyl, (substituted or unsubstituted) benzyl, (substituted or unsubstituted) phenoxy, and (substituted or unsubstituted) benzoxy, and a variety of heterocyclic aromatics having one, two, or three heteroatoms in the ring portion thereof, said heterocyclics being substituted or unsubstituted. The derivatized compounds include, but are not limited to, imidazoles, pyrazoles, thiazoles, isothiazoles, azathiozoles, oxothiazoles, oxazines, oxazolines, oxazaboroles, dithiozoles, triazoles, delenozoles, oxaphospholes, pyrroles, boroles, furans, thiophenes, phospholes, pentazoles, indoles, indolines, oxazoles, isoxazoles, isotetrazoles, tetrazoles, benzofurans, dibenzofurans, benzothiophenes, dibenzothiophenes, thiadiazoles, pyridines, pyrimidines, pyrazines, pyridazines, piperazines, piperidines, morpholones, pyrans, annolines, phthalazines, quinazolines, guanidiniums, quinxalines, choline-based analogues, and combinations thereof. The basic cation structure can be singly or multiply substituted or unsubstituted.

The anionic portion of the ionic liquid can comprise an inorganic moiety, an organic moiety, or combinations thereof. In preferred embodiments, the anionic portion comprises one or more moieties selected from halogens, phosphates, alkylphosphates, alkenylphosphates, bis(trifluoromethylsulfonyl)imide ($NTf_2$), $BF_4$, $PF_6$, $AsF_6$, $NO_3$, $N(CN)_2$, $N(SO_3CF_3)_2$, amino acids, substituted or unsubstituted carboranes, perchlorates, pseudohalogens such as thiocyanate and cyanate, metal chloride-based Lewis acids (e.g., zinc chlorides and aluminum chlorides), or $C_{1-6}$ carboxylates. Pseudohalides are monovalent and have properties similar to those of halides. Examples of pseudohalides useful according to the invention include cyanides, thiocyanates, cyanates, fulminates, and azides. Exemplary carboxylates that contain 1-6 carbon atoms are formate, acetate, propionate, butyrate, hexanoate, maleate, fumarate, oxalate, lactate, pyruvate and the like. Of course, such list is not intended to be an exhaustive listing of all possible anionic moieties possible according to the invention. Rather, a variety of further anionic moieties are also envisioned and encompassed by the present invention. For example, the invention also encompasses ionic liquids based on alkyl imidazolium or choline chloride anol-aluminum chloride, zinc chloride, indium chloride, and the like. Moreover, various further Lewis acid inorganic salt mixtures may be used.

Cellulose precursor materials for this invention can include, but are not limited to, grasswoods, softwoods, hardwoods, plants, and recycled cellulose products such as newspaper and denim.

In the worst case of the invention, the resulting thermal resistivity or R-value (insulating performance metric), is between the range of about 2 to about 3 in SI units of square meter Kelvin per watts ($m^2 \cdot K/W$) or square meter Celsius per watts ($m^2 \cdot {}^\circ C./W$). In a better case of the invention, the resulting R-value is between about 3 to about 4 ($m^2 \cdot K/W$ or $m^2 \cdot {}^\circ C./W$). In the best case of the invention, the resulting R-value is between about 4 to about 6 ($m^2 \cdot K/W$ or $m^2 \cdot {}^\circ C./W$). In some cases, the R-value may be at least about 2 $m^2 \cdot K/W$, 3 $m^2 \cdot K/W$, 4 $m^2 \cdot K/W$, 5 $m^2 \cdot K/W$, 6 $m^2 \cdot K/W$, or more. In some cases, the R-value may be at most about 6 $m^2 \cdot K/W$, 5 $m^2 \cdot K/W$, 4 $m^2 \cdot K/W$, 3 $m^2 \cdot K/W$, 2 $m^2 \cdot K/W$, or less. In some cases, the R-value may be at least about 2 $m^2 \cdot {}^\circ C./W$, 3 $m^2 \cdot {}^\circ C./W$, 4 $m^2 \cdot {}^\circ C./W$, 5 $m^2 \cdot {}^\circ C./W$, 6 $m^2 \cdot {}^\circ C./W$, or more. In some cases, the R-value may be at most about 6 $m^2 \cdot {}^\circ C./W$, 5 $m^2 \cdot {}^\circ C./W$, 4 $m^2 \cdot {}^\circ C./W$, 3 $m^2 \cdot {}^\circ C./W$, 2 $m^2 \cdot {}^\circ C./W$, or less.

In the worst case of the invention, the removal of lignin and hemicellulose occurs on the order of about 0.01 percent (%) to about 10% removal relative to initial chemical compositions. In a better case of the invention, the removal of lignin and hemicellulose occurs on the order of about 10% to about 50% removal relative to initial chemical composition. In the best case of the invention, the removal of lignin and hemicellulose occurs on the order of about 50% to about 99% removal relative to initial chemical compositions. In some cases, it is possible to achieve 100% removal. In some cases, the removal of lignin and hemicellulose may occur on the order of at least about 0.01%, 0.05%, 0.1%, 0.5%, 1%, 5%, 10%, 20%, 30%, 40%, 50%, 60%, 70%, 80%, 90%, 99%, or more. In some cases, the removal of lignin and hemicellulose may occur on the order of at most about 100%, 90%, 80%, 70%, 60%, 50%, 40%, 30%, 20%, 10%, 5%, 1%, 0.5%, 0.1%, 0.05%, 0.01%, or less.

The worst case of the invention involving the methods to removal of lignin would result in the cellulosic materials losing all crystal structure associated with the cellulose fibrils which would result in a loss in surface area. A bad case of the invention would decrease the crystal structure from about 10% to about 99%. Better case, cellulose crystallinity remains only slightly reduced in the range between about 0.01% to about 9%, resulting in a slight increase in surface area and porosity. Best case cellulose crystal structure doesn't change at all, resulting in the highest possible increase in surface area and porosity. In some cases, the removal of lignin would result in a loss of the cellulose crystallinity in the range between about 0% to about 100%. In some cases, the removal of lignin would result in a loss of the cellulose crystallinity of at least about 0.01%, 0.05%, 0.1%, 0.5%, 1%, 5%, 9%, 10%, 50%, 90%, 99%, or more. In some cases, the removal of lignin would result in a loss of the cellulose crystallinity of at most about 100%, 99%, 90%, 50%, 10%, 9%, 5%, 1%, 0.5%, 0.1%, 0.05%, 0.01%, or less.

The solution conditions for the chemical treatment can be conducted from about 0° C. to about 200° C. In some cases, the solution conditions may be at least about 0° C., 5° C., 10° C., 50° C., 100° C., 150° C., 200° C., or more. In some cases, the solution condition may be at most about 200° C., 150° C., 100° C., 50° C., 10° C., 5° C., 1° C., or less. Similarly, the atmospheric conditions can be done under vacuum, standard atmospheric pressure, elevated pressures, or under inert gas conditions.

Applying Invention to Bast Fiber *Cannabis Sativa* (Industrial Hemp Insulating Products).

The industrial hemp will be mechanically processed after harvest. The mechanical processing will include the physical separation of the bast fiber and the hurd. The bast fiber and hurd are cut into smaller pieces with varying ranges of fiber length to create small clumps of individual fibers. In some cases, the size of the bast fiber and/or the hurd can have an average size of about 63.5 millimeters (mm). In some cases, the size of the bast fiber and/or the hurd can have an average size of at least about 63.5 mm. In some cases, the size of the bast fiber and/or the hurd can have an average size of at most about 63.5 mm.

The creation of the insulating material will comprise a volumetric ratio of bast fiber to hurd. The ratio of bast fiber to hurd can be within the range of about 40% by fiber by volume up to about 100% bast fiber by volume, with the remaining material consisting of hemp hurd. In some cases, the ratio of bast fiber to hurd by volume may be at least about 30%, 40%, 50%, 60%, 70%, 80%, 90%, 99%, or more. In some cases, the ratio of bast fiber to hurd by volume may be at most about 100%, 90%, 80%, 70%, 60%, 50%, 40%, 30%, or less.

The classical methods described above for the delignification or pulping of lignocellulosic materials, although each possesses certain practical advantages, can all be characterized as being hampered by significant disadvantages. Thus, there exists a need for delignification or pulping processes which have a lower capital intensity, lower operation costs, either in terms of product yield of the process or in terms of the chemical costs of the process; which are environmentally benign; which produce delignified materials with superior properties; and which are applicable to a wide variety of lignocellulosic feed materials. Such processes should preferably be designed for application in existing pulp mills using existing equipment with a minimum of modifications.

It is known in the prior art that cellulose pulp can be manufactured from wood chips or other fibrous material by the action of oxygen in an alkaline solution. However, the commercial use of oxygen in support of delignification today is limited to final delignification of kraft or sulfite pulps.

The oxygen pulping methods considered in the prior art for the preparation of full chemical pulps can be divided in two classes: two-stage soda oxygen and single stage soda oxygen pulping. Both single stage and two stage processes have been extensively tested in laboratory scale. In the two stage process the wood chips are cooked first in an alkaline buffer solution to a high kappa number after which they are mechanically disintegrated into a fibrous pulp. This fibrous pulp with a high lignin content is further delignified with oxygen in an alkaline solution to give a low kappa pulp in substantially higher yields than obtained in a kraft pulping process.

The single stage process is based on penetration of oxygen through an alkaline buffer solution into the wood chips. The alkaline solution is partly used to swell the chips and to provide a transport medium for the oxygen into the interior of the chip. However, the main purpose of the alkaline buffer solution is to neutralize the various acidic species formed during delignification. The pH should not be permitted to drop substantially below a value of about 6-7. The solubility of the oxygen in the cooking liquor is low and to increase solubility a high partial pressure of oxygen has to be applied.

Several attempts have been made to accomplish oxygen pulping using mechanical and/or chemical processes, but to the inventor's knowledge none has simultaneously addressed all the problem areas described above and the prior art disclosures do not include or suggest any practical and efficient method for the recovery of pulping chemicals.

For example, Worster et al., in U.S. Pat. No. 3,691,008 discloses a two stage process wherein wood chips are subjected to a mild digestion process using sodium hydroxide, after which the cellulosic material is subjected to mechanical defibration, and then treated under heat and pressure with sodium hydroxide and an excess of oxygen. This process requires a large capacity causticizing stage for all types of lignocellulosic raw materials in order to recover the active hydroxide and hence does not give a substantial cost advantage in comparison to kraft pulping. No disclosure is made relating to the recovery of pulping chemicals.

Another example is given in U.S. Pat. No. 4,089,737, wherein cellulosic material is delignified with oxygen which previously has been dissolved into a fresh alkaline medium. The use of magnesium carbonate as a carbohydrate protector is described as well as the use of a two stage reaction zone design with liquor transfer between the stages. No disclosure is made relating to the recovery of the pulping chemicals.

In U.S. Pat. No. 4,087,318 a manganese catalyst is used to increase the selectivity in an oxygen delignification process. The patent describes a pretreatment step wherein metal ions which catalyze the degradation of carbohydrates are removed before the oxygen delignification is carried out. Oxygen pulping is carried out in the presence of a catalytically active manganese compound using sodium bicarbonate as buffer alkali. The reaction temperature ranges from 120 to 160° C. and the liquor-to-wood ratio is in the order of 14:1. No disclosure is made relating to the recovery of the pulping chemicals and catalysts and the problem of obtaining economically recoverable spent liquor from the pretreatment and pulping stages is not addressed.

U.S. Pat. No. 4,045,257 discloses a process for the production of a chemical pulp from lignocellulosic material and the recovery of chemicals used in said process. The process comprises subjecting a stream of comminuted lignocellulosic material to a pretreatment in the form of precooking and defibration of the precooked material followed by reaction of the thus pretreated lignocellulosic material with an oxygen-containing gas in the presence of an alkaline buffer solution in order to obtain a stream of at least partially delignified lignocellulosic material, spent liquor being extracted from both the precooking and the pulping steps and subjected to wet combustion for recovery of chemical substances from the spent liquor to be recirculated in the process. The only route for recovery of chemicals suggested in U.S. Pat. No. 4,045,257 is a wet combustion process which would be impractical and undesirable for use in practice as unavoidable formation of large quantities of carbon dioxide during wet combustion would cause excessive corrosion and undesirable formation of alkali bicarbonates in the pulping liquor. The chemical environment in a wet combustion reactor would also fully oxidize any inorganic and organic chemicals and additives or additive precursors used which may result in their complete inactivation. Wet combustion is not particularly energy efficient and recovery of high pressure steam for electricity generation or formation of a valuable synthesis gas is not possible.

The present invention does not require prehydrolysis steps that are implemented in prior art to dissolve hemicellulose which could make accessing lignin easier. These techniques include, alkali soaking at temperatures of 170° C. and above, transition metal catalysts, acid washes, and steam explosion. The invention requires a single hydrolysis step in which both the lignin and hemicellulose are removed by a single step chemical treatment. This is important because these additional steps are costly at scale, require environmentally hazardous chemicals, rely on significant thermal energy input, and require special equipment that may not degrade due to the presence of strong oxidizers at high temperatures.

The invention can include mechanical pretreatments such as grinding, fluffing, wafering, milling, cutting, and fiberizing. The goal of this mechanical pretreatment is to further expose the hemicellulose and lignin that need to be selectively depolymerized. This is achieved due to the increase in surface area to volume ratio associated with reducing particle size which allows for more effective penetration of the proceeding chemical treatment. The average particle size should be between about 1 mm to about 63.5 mm. In some cases, the average particle size may be at least about 0.1 mm, 0.2 mm, 0.4 mm, 0.6 mm, 0.8 mm, 1 mm, 2 mm, 4 mm, 6 mm, 8 mm, 10 mm, 20 mm, 30 mm, 40 mm, 50 mm, 60 mm, 70 mm, or more. In some cases, the average particle size may be at most about 70 mm, 60 mm, 50 mm, 40 mm, 30 mm, 20 mm, 10 mm, 8 mm, 6 mm, 4 mm, 2 mm, 1 mm, 0.8 mm, 0.6 mm, 0.4 mm, 0.2 mm, 0.1 mm, or less.

The solution composed of fiber, hurd, and chemical solvents can be mechanically stirred but is not required. The temperature of the solution can be within the range between about 20° C. to about 130° C. In some cases, the temperature of the solution may be at least about 10° C., 20° C., 40° C., 60° C., 80° C., 100° C., 120° C., 130° C., or more. In some cases, the temperature of the solution may be at most about 130° C., 120° C., 100° C., 80° C., 60° C., 40° C., 20° C., 10° C., or less.

The solution is heated until steady state is reached for the entirety of this chemical process. The solution heating process time may range from about 10 minutes (min) to about 7 hours (h). The solution heating process may be at least about 1 min, 5 min, 10 min, 30 min, 1 h, 2 h, 3 h, 4 h, 5 h, 6 h, 7 h, or longer. The solution heating process may be at most about 7 h, 6 h, 5 h, 4 h, 3 h, 2 h, 1 h, 30 min, 10 min, 5 min, 1 min, or shorter.

The depolymerizing chemical solvents may be reintroduced (recharged) into the solution as frequently as every hour interval, or not recharged at all. In some cases, the depolymerizing chemical solvents may be reintroduced at a time interval of about 1 h. In some cases, the depolymerizing chemical solvents may be reintroduced at a time interval of more than 1 h. In some cases, the depolymerizing chemical solvents may be reintroduced at a time interval of less than 1 h.

At the completion of the chemical treatment, the solvent can be drained and regenerated for reuse up to 4 times with little to no loss in their effectiveness. In some cases, the solvent may be drained and regenerated for reuse up to more than 4 times. In some cases, the solvent may be drained and regenerated for reuse up to less than 4 times. Many valuable components from the cellulosic anatomy will be found within the solvent stream including but not limited to: cellulose sugars, xylose sugars, lignin, lignin derivatives, pectin, and alcohol precursor materials. The selective depolymerization of cellulose and maintaining original crystal structure allows for a less chemical intensive process to the material. This allows for easier isolation of the many valuable components within the post chemical treatment solvent by allowing fewer oxidation reactions to occur that would otherwise destroy the molecular nature of these valuable components.

The remaining pulp is then dried with either fans and or conventional ovens, at temperature range between 110-135 degrees Fahrenheit (° F.). The heat range is specific to the material so that the cellulose crystal structure created is maintained and not disrupted due to excess heat. In some cases, the remaining pulp may be dried at a temperature of at least about 100° F., 110° F., 120° F., 130° F., 140° F., or more. In some cases, the remaining pulp may be dried at a temperature of at most about 140° F., 130° F., 120° F., 110° F., 100° F., or less.

The drying process can include the use of ethanol to displace the water found within the pores and cavities of the material created. Ethanol will displace the water and also has a lower boiling point temperature, which will lead to quicker drying.

The pulp is then left with air-filled voids or pressurized in an inert gas environment due to higher thermal resistance of CO2, H2 gases and similar gases compared to air.

The chemical solvent may also be regenerated or recycled. This is most often achieved by pH adjustments, and application of pressure or vacuum.

At the completion of the wet chemical process, fire retardant materials are then added. Flame retardants can include, but are not limited to, borate derivatives, magnesium oxides, oxides, organics, and acrylates. The fire retardants can be added to the material with fraction of 6-30% by weight.

Alternatively or in addition to, the fire retardants may be organohalogen compounds. Examples of the organohalogen compounds include: organochlorines (e.g., chlorendic acid derivatives and chlorinated paraffins); organobromines (e.g., decabromodiphenyl ether (decaBDE); polymeric brominated compounds (e.g., brominated polystyrenes, brominated carbonate oligomers (BCOs), brominated epoxy oligomers (BEOs), tetrabromophthalic anyhydride, tetrabromobisphenol A (TBBPA), and hexabromocyclododecane (HBCD)); and mixtures thereof.

Alternatively or in addition to, the fire retardants may be organophosphorous compounds. Examples of the organophosphorous compounds include: organophosphates (e.g., triphenyl phosphate (TPP), resorcinol bis(diphenylphosphate) (RDP), bisphenol A diphenyl phosphate (BADP), and tricresyl phosphate (TCP)); phosphonates (e.g., dimethyl methylphosphonate (DMMP)); phosphinates (e.g., aluminium diethyl phosphinate); and mixtures thereof.

Alternatively or in addition to, the fire retardants may be silica based aerogels. Silica aerogels are fire resistant and provide inherent insulating properties in addition to the porous cellulose—fire retardant composite created herein.

In some cases, the fire retardants may contain both the phosphorus and halogen (e.g., tris(2,3-dibromopropyl) phosphate (brominated tris), tris(1,3-dichloro-2-propyl)phosphate (chlorinated tris or TDCPP), and tetrakis(2-chloroethyl)dichloroisopentyldiphosphate)).

Additionally, crosslinking agents can be mixed with the fire retardants to induce gelling. This creates a fire retardant with increased viscosity for more effective chemical bonding onto the cellulose pores for increased insulation performance. Examples of a crosslinking agent to fire retardants includes polyvinyl alcohol in addition to water. Current methods of adding fire retardant additives to cellulose include a dry process and primarily induce physical bonding.

The created fire retardant has a viscosity in between about 10 centipoise (cP) to about 10,000 cP to induce further chemical bonding to cellulose. In some cases, the viscosity of the created fire retardant may be at least about 1 cP, 5 cP, 10 cP, 50 cP, 100 cP, 500 cP, 1,000 cP, 5,000 cP, 10,000 cP, or more. In some cases, the viscosity of the created fire retardant may be at most about 10,000 cP, 5,000 cP, 1,000 cP, 500 cP, 100 cP, 50 cP, 10 cP, 5 cP, 1 cP, or less.

The material will then be fiberized and will have the fire retardants added either prior, during or after fiberization. Fiberization is the typical blown cellulose insulation manufacturing process that is used to achieve the material's overall macroscopic density by chopping of the input fibers and creating a material of low density with known average fiber size, which increases insulation properties. The material created herein is manufactured similarly to these blown cellulose insulation materials, but is unique and innovative due to the porosity not just existing at the macro scales. The material created has cellulosic material components depolymerized which creates micro and nanopores which increase thermal and acoustic insulating performances. The material is then subjected to fiberization which results into small clumps individual fibers, with fiber lengths having an average of about 63.5 mm. The average fiber length may be at least about 63.5 mm. The average fiber length may be at most about 63.5 mm. The material created has a density ranging between about 2.5 pounds per cubic food (1b/ft$^3$) to about 3.7 lb/ft$^3$. The density of the material created may be at least about 1 lb/ft$^3$, 2 lb/ft$^3$, 2.5 lb/ft$^3$, 3 lb/ft$^3$, 3.5 lb/ft$^3$, 4 lb/ft$^3$, or more. The density of the material created may be at most about 4 lb/ft$^3$, 3.5 lb/ft$^3$, 3 lb/ft$^3$, 2.5 lb/ft$^3$, 2 lb/ft$^3$, 1 lb/ft$^3$, or less. The material can be dry or slightly wet during the addition of the fire retardants. The resulting material consists of small clumps of insulating fibers which have open and closed cells and are fire resistant. The material is also flexible and can take the shape of any cavity it is installed into.

The fire retardants added can consist of borate based fire retardants including: aluminum ammonium sulfate; magnesium silicate; aluminum hydroxide; and mixtures of calcium magnesium carbonate and hydrated magnesium carbonate hydroxide, or wood ash based fire retardant including: potash alum (potassium aluminum sulfate); calcium carbonate; sodium carbonate; talc; or clay.

The addition of the fire retardant allows for the creation of closed cell, or semi-closed cell pores within the material due to the chemical treatment's creation of porosity and the selective blocking of macro and nanopores within our material. In the worst-case scenario, the fire retardants create a semi-closed cell material for a slight increase in R Value, where about 10% to about 70% of the open cells are converted to closed cell. In the best case, the fire retardants allow for the creation of closed cells for highest R Value increase, where about 70% to 100% of open cells are converted to closed cell. In some cases, at least about 10%, 20%, 30%, 40%, 50%, 60%, 70%, 80%, 90%, 99%, or more of the open cells may be converted to the closed cell. In some cases, at most about 100%, 90%, 80%, 70%, 60%, 50%, 40%, 30%, 20%, 10%, or less may be converted to the closed cell.

The fire retardant can be applied within a range of about 5% to about 70% retardant by weight. In some cases, the fire retardant may be at least about 5%, 10%, 20%, 30%, 40%, 50%, 60%, 70%, or more by weight. In some cases, the fire retardant may be at most about 70%, 60%, 50%, 40%, 30%, 20%, 10%, 5%, or less by weight.

The viscous, wet fire retardants are added onto the chemically treated porous fibers through a pneumatic mechanical process at a specific flow rate. Pneumatic mechanical processes have mass transport of specific materials through pressurized air flows induced by high strength fans. The fibers will also be fed into the mechanical pneumatic system at a specified flow rate. The fire retardants can have mass flow rates ranging from about 0.1 grams/seconds (g/s) to about 5000 g/s. The treated porous fibers can have mass flow rates ranging from about 0.1 to about 5000 g/s.

The combination of cellulosic material and fire retardant is then dried. The drying mechanism can be through convection, conduction, or radiation and can take place across a range of temperatures from ambient (e.g., about 77° F.) to about 150° F. Mechanical drying through use of fans may be implemented to induce evaporative effects. Sufficient drying will be achieved when the weight of the sample is substantially constant for about 10 min. The weight of the product will continue to drop as more and more water vaporizes at elevated temperatures. It is understood that the material will reabsorb ambient water vapor up to approximately 6% by weight after the drying process, but to remove any residual solvents monitoring the weight will be of great value. Drying temperature is specific to the cellulose material used so that maintaining crystal structure is not compromised.

In some cases, the cellulosic fibers may be wetted with water prior to the addition of fire retardants. Such wetting may increase fiber weights by a range between about 5% to about 15% by weight. Wetting can be performed through spraying, misting, and/or steaming of water onto fiber surfaces. Subsequently, dry fire retardant powders can be added to the wet fibers through mechanical and pneumatic processes with uniform distribution to induce future liquefying of the solid powders into viscous forms, thereby to promote fire retardant binding onto the fiber pores and surfaces.

In some cases, the fire retardants can be liquefied and then added as a viscous material onto the fiber pores and surfaces through heating methods.

In some cases, a steam vent or chamber may be introduced after the fibers have been converted into a non-woven web of insulation with predetermined composition. The steam may be used to further wet the fibers to induce liquefying of remaining dry solid powders. The remaining fire retardant powders that may be dry (e.g., in a solid form) in the non-woven insulation web may include about 1% to about 85% of the total initial fire retardant weight initially introduced into the composite non-woven web. The liquefaction process can improve the capping ability of these fire retardants due to increased chemical and physical bonding.

In some cases, the steam can make contact with the composite non-woven web through any surface and direction of flow rate.

In some cases, the steam can be introduced through many pipes, ranging in sizes of about 0.75 inches to about 12 inches.

In some cases, the steam introduced can be wet (unsaturated steam), dry (saturated steam), or superheated. In some cases, the steam may have a flow rate between about 9 lb/hour to about 81,000 lb/hour per square foot of composite non-woven insulation manufactured.

In some cases, the manufactured composite non-woven insulation that includes the fire retardant can be subjected to heat. Such manufactured composite non-woven insulation can be introduced to a heater (e.g., in an oven or a thermo-bonding oven, etc.) to further induce hardening or gelling of the fire retardants onto the fiber pores and surfaces. Such heating may promote increased bonding (e.g., a physical bonding, adhesion, etc.) between the fire retardant and the fibers (cellulosic materials). As the fibers continue to remain in the heater, drying may occur. Such drying may induce capping of the fiber pores. The initial natural fiber water content may range from about 3% to about 11% by weight in the web, prior to heating. In some cases, the initial water content in the natural fiber prior to heating may be at least about 1%, 2%, 3%, 4%, 5%, 6%, 7%, 8%, 9%, 10%, 11%, 12%, 15%, 20% or more by weight. In some cases, the initial water content in the natural fiber prior to heating may be at most about 20%, 15%, 12%, 11%, 10%, 9%, 8%, 7%, 6%, 5%, 4%, 3%, 2%, 1%, or less by weight. An additional input of water moisture content for the non-woven composite may be introduced, thereby increasing the water moisture content by about 5% to about 20% by weight, prior to heating. In some cases, the water moisture content may be increased by at least about 1%, 5%, 10%, 15%, 20%, 25%, 30%, or more by weight. In some cases, the water moisture content may be increased by at most about 30%, 25%, 20%, 15%, 10%, 5%, 1%, or less by weight. After heating, remaining water content may range from about 3% to about 11%. In some cases, the remaining water content may be at least about 1%, 2%, 3%, 4%, 5%, 6%, 7%, 8%, 9%, 10%, 11%, 12%, 15%, 20% or more by weight. In some cases, the remaining water content may be at most about 20%, 15%, 12%, 11%, 10%, 9%, 8%, 7%, 6%, 5%, 4%, 3%, 2%, 1%, or less by weight. In some cases, the heating process may range between about 10 min to about 90 min. In some cases, the heating process may be at least about 1 min, 5 min, 10 min, 50 min, 90 min, 100 min, 200 min, or more. In some cases, the heating process may be at most about 200 min, 100 min, 90 min, 50 min, 10 min, 5 min, 1 min, or less. In some cases, the heating process may be one continuous heating process. In some cases, the heating process may occur in intervals. In some cases, the heating process may depend on water moisture content. In some cases, the heating temperature may range between about 100° C. to about 500° C. In some cases, the heating temperature may range between about 175° C. to about 350° C. In some cases, the heating temperature may be at least about 100° C., 125° C., 150° C., 175° C., 200° C., 250° C., 300° C., 350° C., 400° C., or higher. In some cases, the heating temperature may be at most about 400° C., 350° C., 300° C., 250° C., 200° C., 175° C., 150° C., 125° C., 100° C., or lower.

In some cases, the final material may be subjected to a water, oil, or emulsion based dye. The results should induce color change of the material to allow for recognizable branding. The dye is applied to the material before or after drying. The color can be added onto the material during post chemical washing through a water-soluble dye. The color can also be added onto the material post fiberization with a spray applied dye. Dying is not a requirement for the product but is attractive to the consumer eye and resembles healthiness and cleanliness.

Selective Depolymerization and its Effects on Thermal Resistivity

The selective removal, or depolymerization, of lignin and hemicellulose biopolymers will induce anatomical changes within the anatomy of the cellulose fibril matrix.

Cellulose with high crystal structure is more thermally stable compared to lignin and hemicellulose. This is due to the absence of highly amorphous regions which can be found in lignin and hemicellulose. Phonon transportation through the stable cellulose is thus inhibited due to its ability to maintain structural integrity during conduction, convection and radiation forms of heat transfer.

The chemical treatment mechanisms are acid hydrolysis, coordinating anion attack of bonds, or oxidation within the lignin structures. Specifically, the bonds targeted for cleavage are the aryl ethyl bonds that connect the phenolic groups of the lignin structure. Under hydrolysis conditions, the hemicellulose components are solubilized and the lignin is partially hydrolyzed by cleavage of α-aryl and phenolic β-O-4 ether linkages. FIG. 1 illustrates the two possible mechanisms pathways for acid hydrolysis with and without the coordinating anion. The resulting structures have increased solubility in polar solvents, specifically water, which allow for their removal from the cellulose structure. Specifically the invention targets the b-O-4 linkages of the lignin molecules by making the structures more susceptible to hydrolysis (introduction of —OH and H to a molecule) by introducing protons in the form of acid to make the structure more susceptible to the addition of water.

Mechanism for Acid Catalyzed Hydrolysis of b-O-4 Linkages in Ionic Liquids with coordinating anion includes: (1) Protonation of the benzylic alcohol; (2) Elimination of $H_2O$ through E2 mechanism to form alpha-beta unsaturated enol ether; (3) Hydration of C═C double bond followed by proton transfer to form hemiacetal; and (4) Protonation of phenolic oxygen followed by elimination mechanism to form phenolic derivative and Hibbert's ketone.

Mechanism for Acid Catalyzed Hydrolysis of b-O-4 Linkages in Ionic Liquids without coordinating anion includes: (1) Protonation of the benzylic alcohol; (2) Elimination of $H_2O$ and formaldehyde to form enol ether; (3) Hydration of C═C double bond and proton transfer to form hemiacetal; and (4) Protonation of phenolic oxygen followed by elimination to form phenolic derivative and vinyl alcohol.

The hemicellulose structures are predisposed to being dissolved by polar based solvents, specifically water. The predisposition is especially true in acidic conditions such as the one described by the present invention. This is due to the low degree of crystallinity, and lower molecular weight relative to cellulose and lignin.

Figure 2:
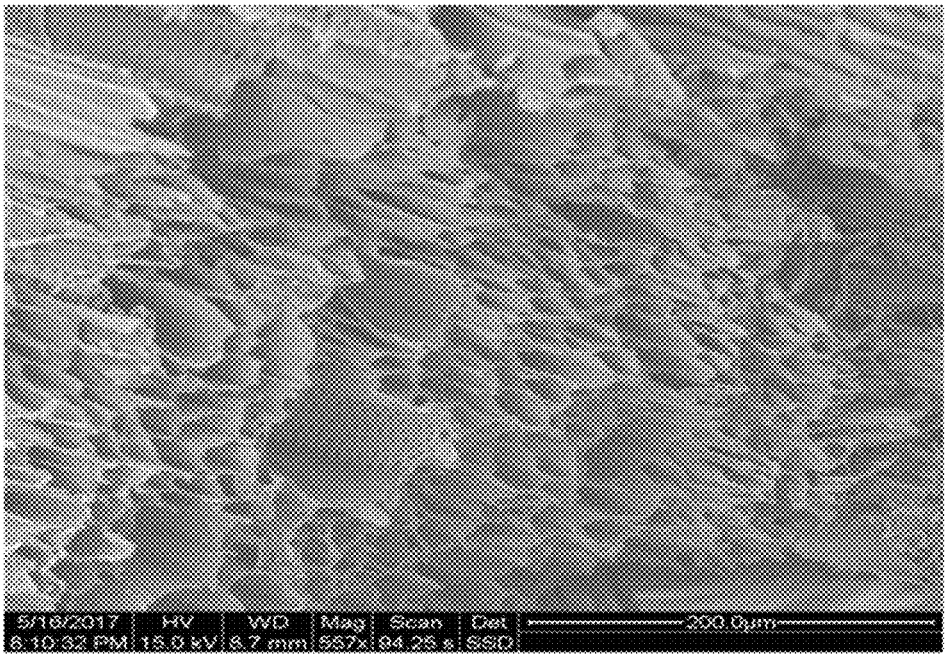
FIG. 2 shows a scanning electron microscopy (SEM) image of a cellulosic material following delignification.
Figure 3:
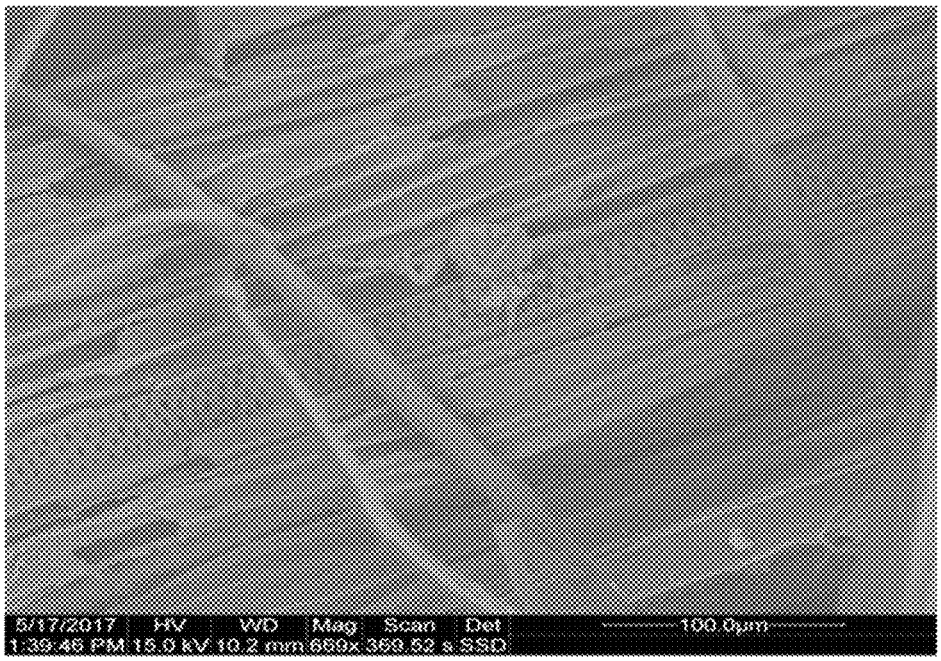
FIG. 3 shows an SEM image of another cellulosic material following delignification.

Removing the secondary support structures of cellulose will induce cellulose agglomeration to form macro and nano scale voids within the cellulose matrix. This is especially true within areas of the plant material that specifically have high lignin concentration such as the secondary cell wall. The agglomeration of cellulose fibrils along the secondary cell wall results in long hollow tubes that run the length of the fibril as shown in SEM images in FIG. 2 and FIG. 3. The result is reduced density of the material due to the removal of the described components, and similarly an increase in the presence of insulating air.

The application of the fire retardants, wet or dry, will close off the newly created voids making them closed cell air pockets. The fire retardants are added as an additional layer to the surface of the insulation material created. It is applied to the material in a weight percentage between 5-30%. It is understood that closed cell insulation is a method for establishing insulating air pockets, and is the underlying principle of insulation mechanisms for other insulating materials such as aerogels and foams.

To maintain maximum surface area of closed cell voids, the cellulose crystal structure must be maintained. This can be determined by characterization techniques such as X-Ray Diffraction (XRD), Differential Scanning calorimetry (DSC), and Thermogravimetric Analysis (TGA). XRD exposes the material to X-ray radiation at a variety of angles that interact with the atomic lattice. The interactions and returning X-ray energy can be recorded and analyzed to determine percent crystallinity. This is achieved by observing the characteristic intensities of the crystalline region of cellulose, which is known to occur at 22.6°. The amorphous or non-crystalline region of cellulose occurs at 18.06°, and this intensity is mathematically related to the observed intensity of the crystalline cellulose region, which gives an approximation to the overall percent crystallinity of the remaining cellulose. The mathematical equation is listed as follows (Equation 1):

$$\% \text{ Crystalline} = I_{22}/I_{22}+I_{18}\times 100$$

Figure 4:
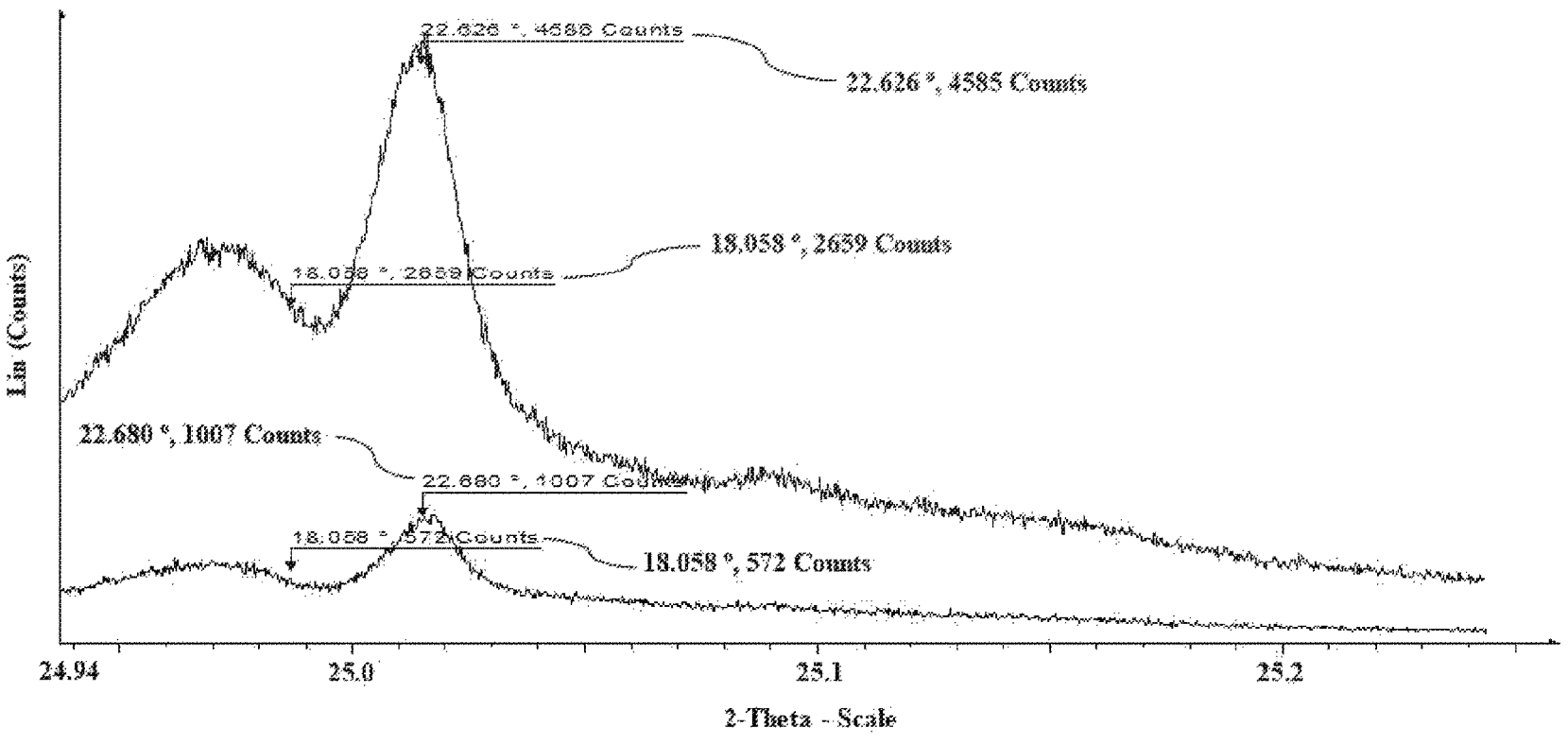
FIG. 4 shows X-ray diffraction spectra of cellulosic materials with and without delignification.

XRD results shown in FIG. 4 indicate that the described invention maintains cellulose crystal structure. Both the control and the chemically depolymerized samples exhibited approximately 63% cellulose crystallinity. In theory, the described invention maximizes available closed cell insulating surface area.

The method of inducing closed cell voids within cellulosic materials also increases the acoustic insulating performance by the same principles described. This is an important feature that current thermal insulators fail to provide.

Extraction and Isolation of Byproducts

The residual liquid (named liquor) that remains from the chemical treatment may include solvent, dissolved or undissolved solids, chemical compounds, isolated components, thermal energy, and any derivative of the lignocellulosic anatomy.

From the liquor, a number of extraction techniques may be applied to isolate and collect chemical compounds including but not limited to: cyclic compounds (sugars and carbohydrates), noncyclic compounds, Carboxylic Acids, Acid Anhydrides, Esters, Acyl Halides, Amides, Nitriles, Aldehydes, Ketones, Alcohols, Thiols, Amines, Ethers, Sulfides, Alkenes, Alkynes, Alkyl Halides, Nitro groups, Alkanes, non-organics, ionic liquids, protons, and any common derivative of cellulose, hemicellulose, lignin, or pectin.

Extraction may be liquid-liquid extraction or solid phase extraction. Extraction chemicals can be nucleophilic, electrophilic, acidic, basic, neutral, metallic, inorganic, polar, nonpolar, organic, and in solid, liquid, or gas phases.

The extraction may be conducted under vacuum, ambient atmospheric pressure, or with increased pressure.

The extraction may be conducted within a temperature range of −50° to 110° C.

Further techniques may be implemented to isolate or purify the desired byproduct.

Example 1

Figure 5:
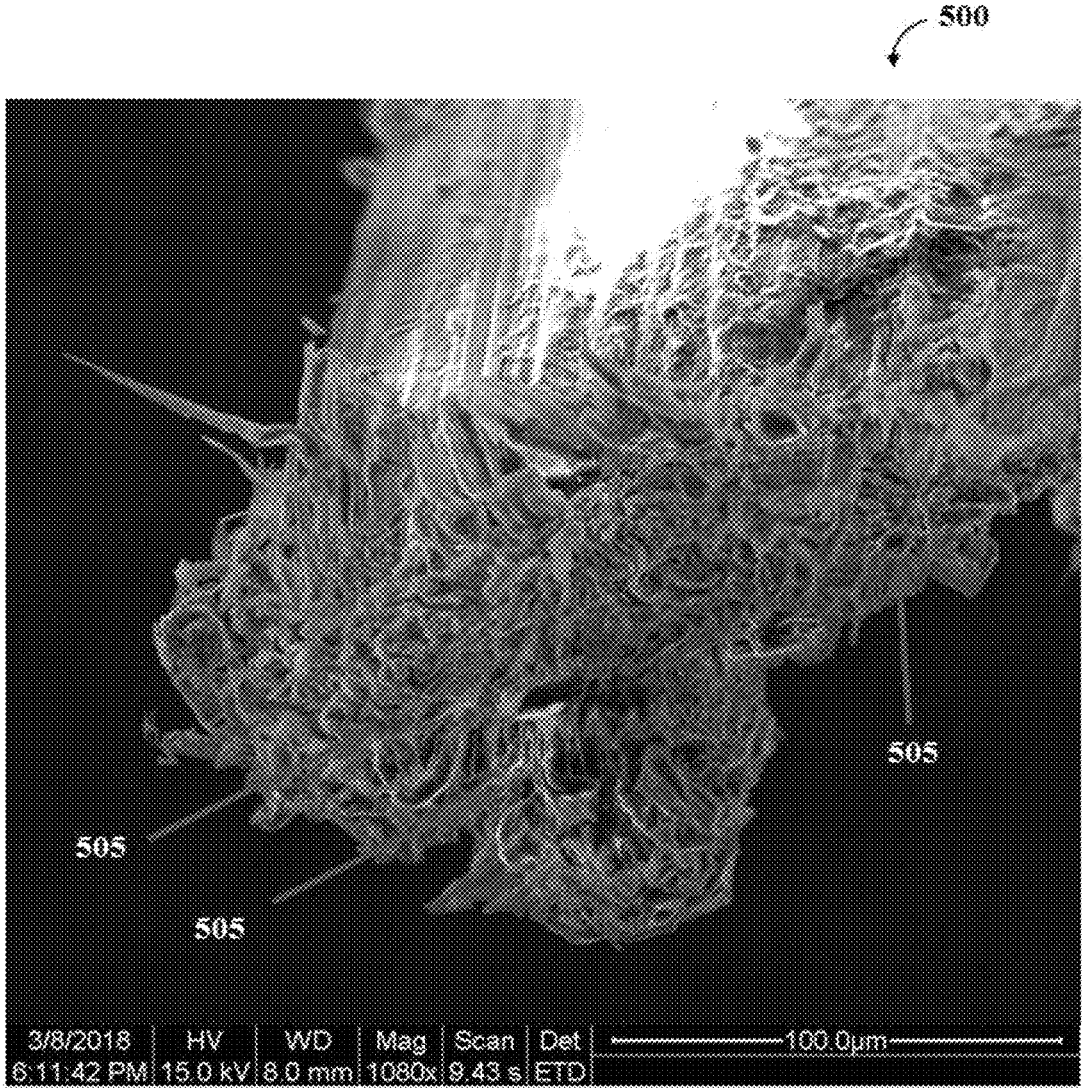
FIG. 5 shows an SEM image of a cellulosic material prior to delignification.

The following examples provide scanning electron microscopy (SEM) images of an industrial hemp. FIG. 5 shows an SEM image of a non-delignified industrial hemp 500, exhibiting a densely packed network of the fiber tip 505. Inherent porosity of the non-delignified industrial hemp may be minimal as the cellulose bundles are tightly packed with hemicellulose and lignin reside between the longitudinal cellulose strands.

Figure 6:
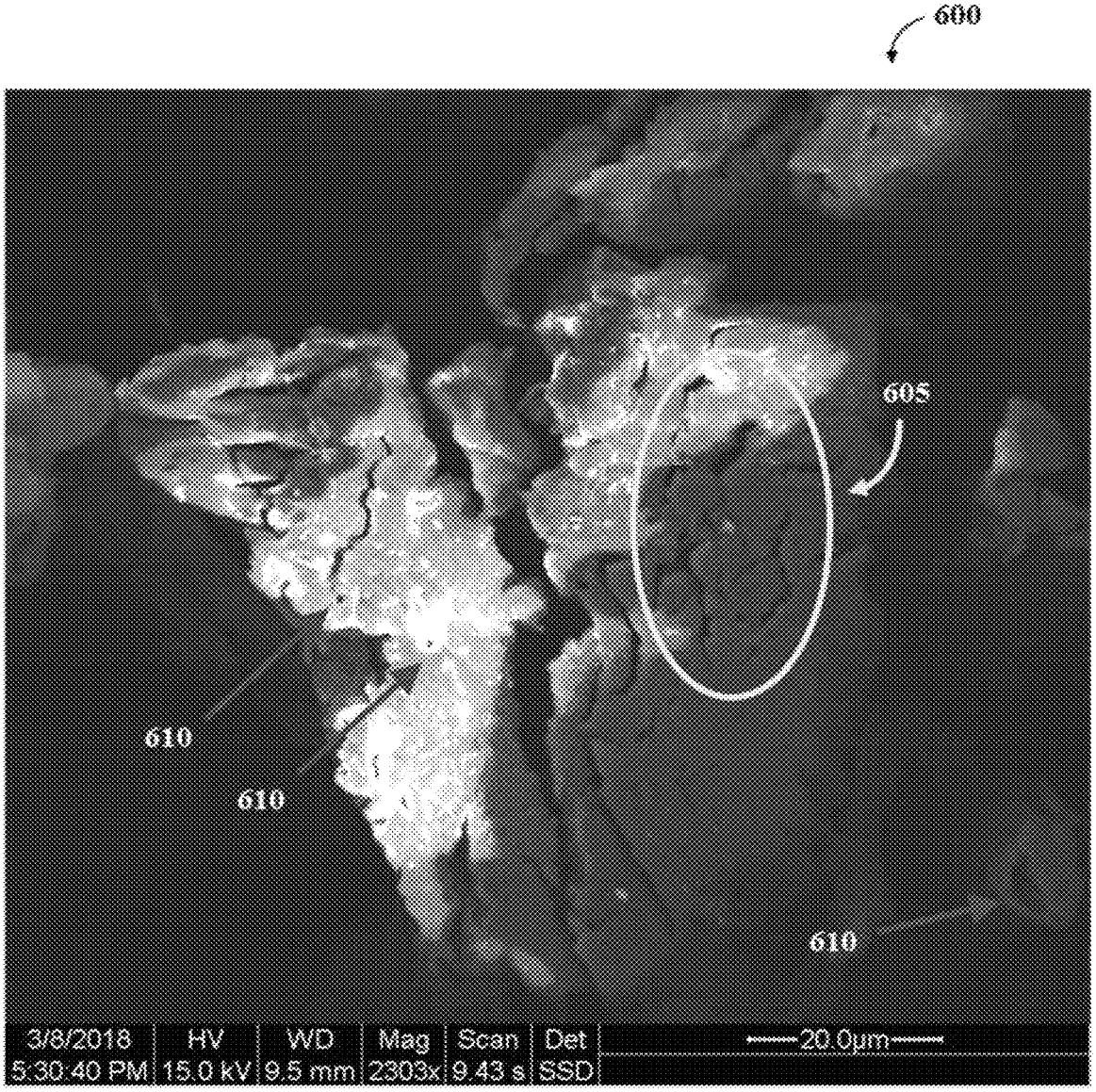
FIG. 6 shows an SEM image of a delignified cellulosic material that is treated with a fire retardant.

FIG. 6 shows an SEM image of a delignified industrial hemp 600, showing increased porosity that runs longitudinally along the fiber. The area 605 may indicate significant cellulose agglomeration due to the removal of lignin and hemicellulose that would normally keep the cellulose fibrils in place. Nanopores (e.g., having a cross-sectional dimension of less than about 1 micrometer) and/or micropores (e.g., having a cross-sectional dimension of 1 micrometer or greater) may be created between the cell walls upon the cellulose agglomeration. Pores 610 in the delignified cellulosic material may have dimensions in the nanoscale (e.g., less than 1 realizing only limited insulating properties.

Figure 7:
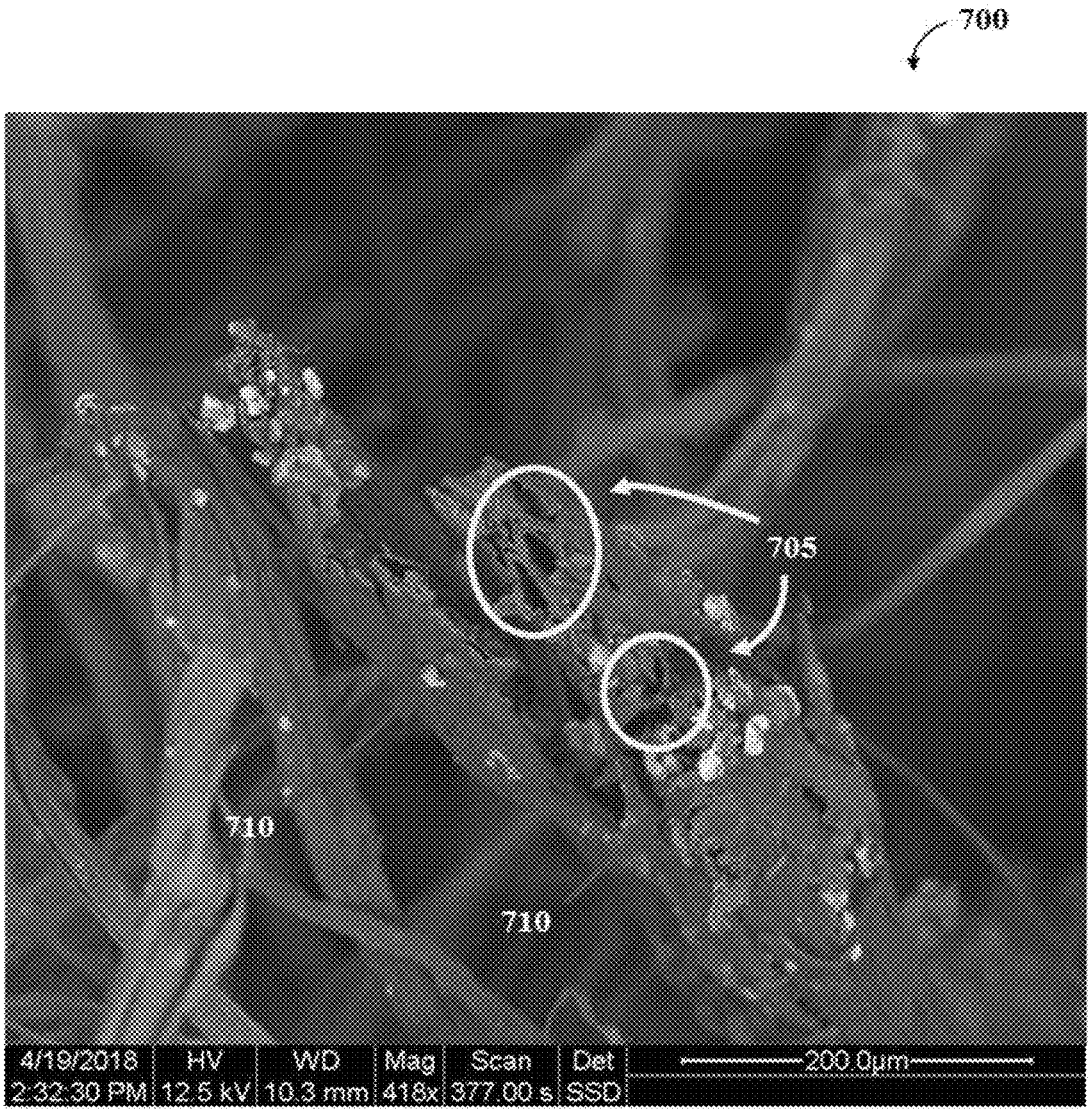
FIG. 7 shows an SEM image of another delignified cellulosic material that is treated with a fire retardant.

FIG. 7 shows an SEM image of a delignified industrial hemp 700 that has been treated with a fire retardant solution. A formation of micropores 705 may be due cellulose agglomeration following delignification (e.g., bleaching) prior to the treatment with the fire retardant solution. In some cases, as shown in FIG. 7, the treatment of the delignified industrial hemp with the fire retardant solution (e.g., boric acid) may not yield a complete capping of the micropores by the fire retardant particles 710.

Figure 8A:
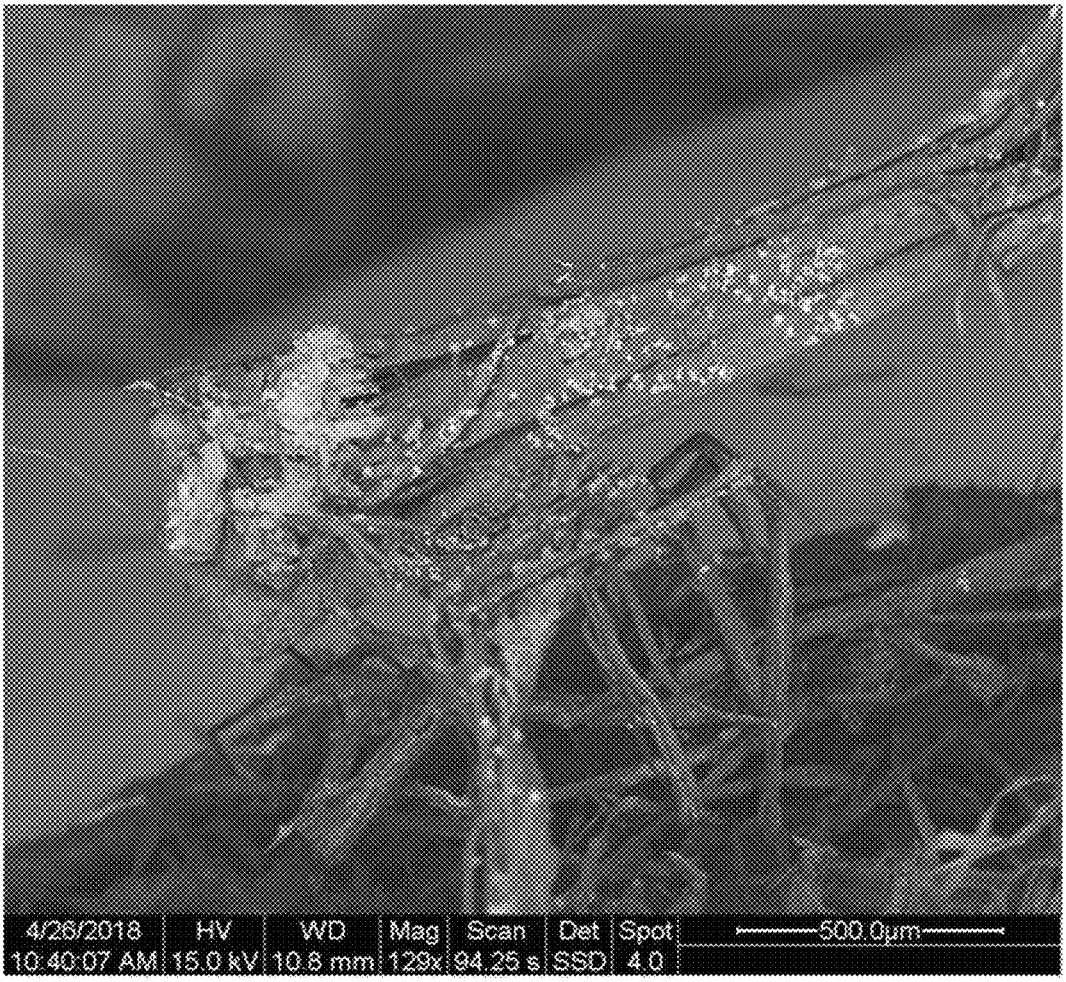
FIG. 8A-8C show SEM images of delignified cellulosic materials that are treated with a gel-like solution of the fire retardant.
Figure 8B:
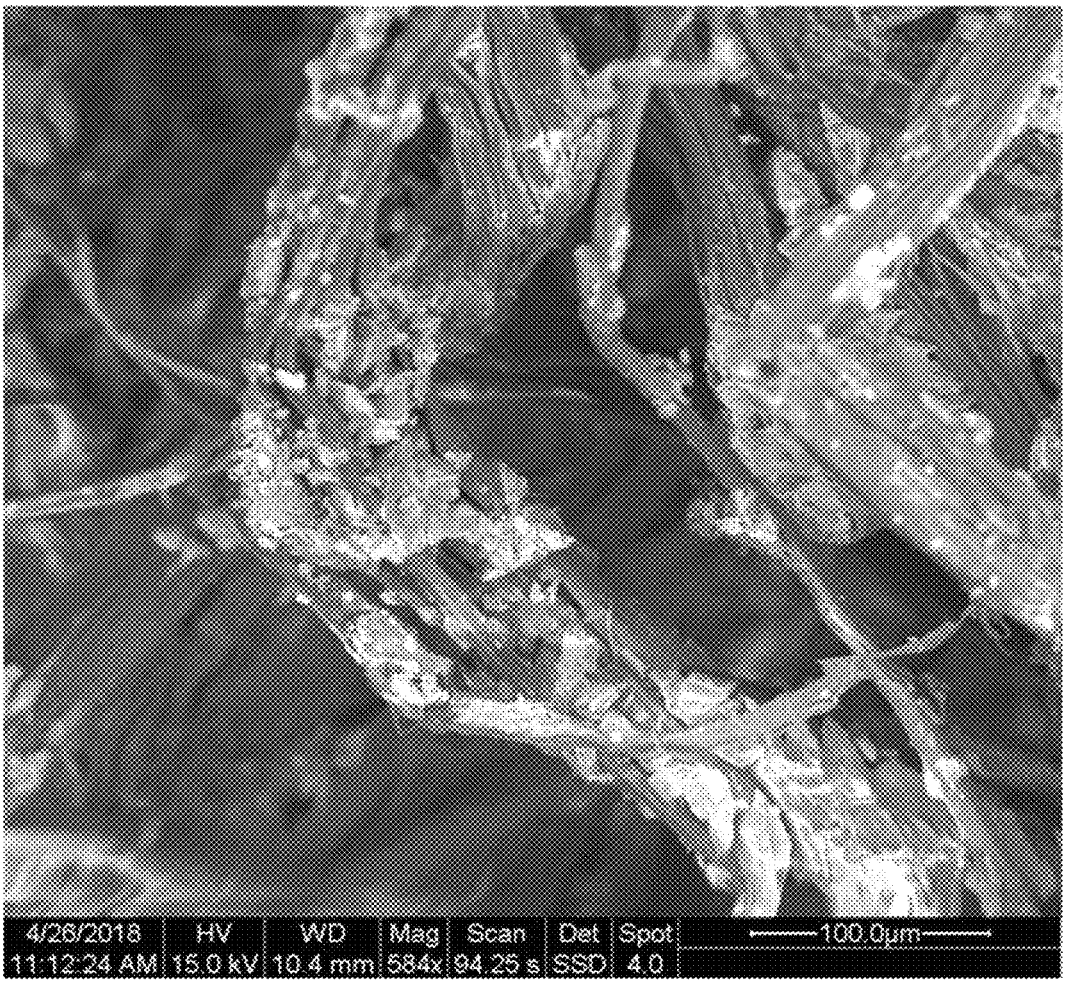
Figure 8C:
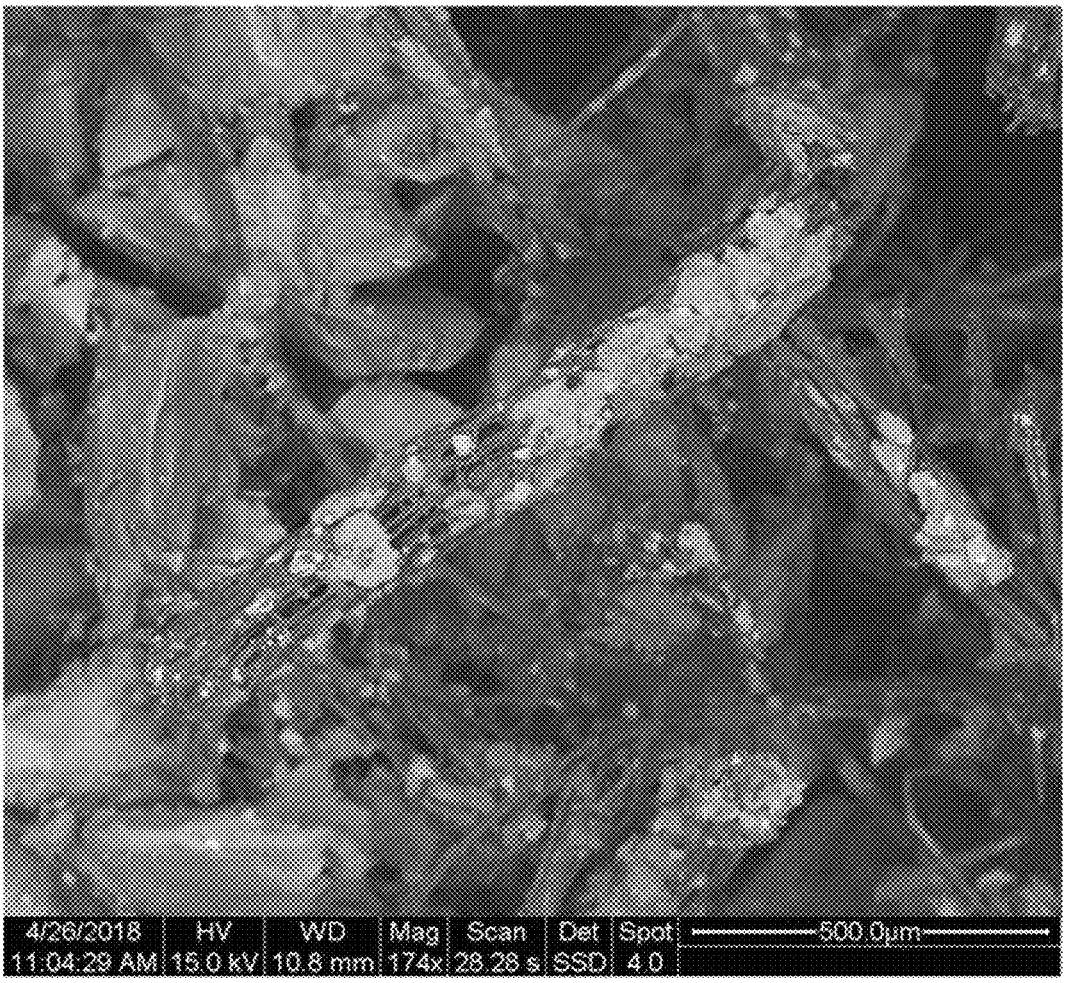

FIG. 8A-8C show SEM images of delignified industrial hemp 800, 810, and 820 that have been treated with fire retardants. After delignifying the industrial hemp, the fire retardant may be added to the industrial hemp in a condition that allows crystallization of the fire retardant (e.g., boric acid) particles on the surface of the pores of the delignified industrial hemp. Most current methods add the fire retardant (i) as solids, thereby keeping the fire retardant between the fibers and not physically bonded to them or (2) in liquid solvent such as water which can lead to crystals that are too big or too small. Both methods can reduce effectiveness of capping the pores of delignified natural fibers. In some cases, a proper concentration, temperature, and soak time may promote the crystallization on the surface and not just within the fiber porosity itself. FIG. 8A-8C show SEM images of delignified industrial hemp 800, 810, and 820 that were treated with a gel-like solution of the fire retardant. The gel-like solution of the fire retardant is prepared by heating the fire retardant to a processing temperature, then adding a processing solution (e.g., water) to the fire retardant. In some cases, the fire retardant may be boric acid. In some cases, the processing temperature may range between about 30° C. to about 80° C. In some cases, the fire retardant that is heated to the processing temperature may be mixed with a processing solvent to a concentration ranging between about 1 gram of the fire retardant per 1 milliliter (mL) of the processing solvent to about 10 grams of the fire retardant per 1 milliliter (mL) of the processing solvent. In some cases, a different solvent other than water may be used. In an example, boric acid may be heated to 50° C., then mixed with water to 5.4 grams of boric acid per 1 mL of water. As shown in FIG. 8A-8C, the use of the gel-like solution of the fire retardant results in can result in a formation of a plurality of pores within and between the delignified fibers. Such semi-viscous borates (i.e., gels) can be effective at keeping the crystallized particle size small enough to crystallize on the surface of the pores and effectively cap the pores.

Figure 9A:
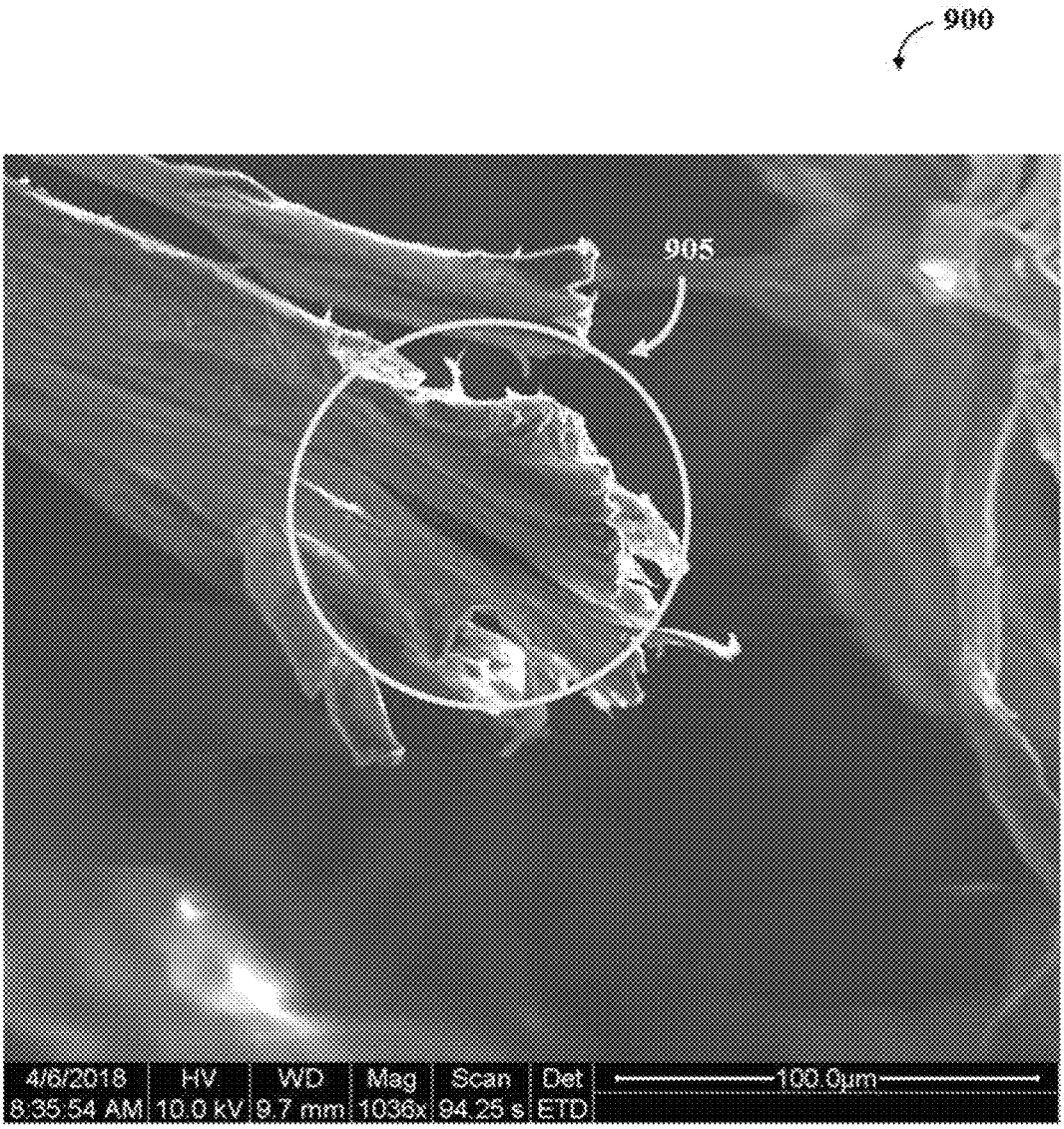
FIG. 9A-9C show SEM images of the delignified cellulosic materials that are treated with a different solution of the fire retardant.
Figure 9B:
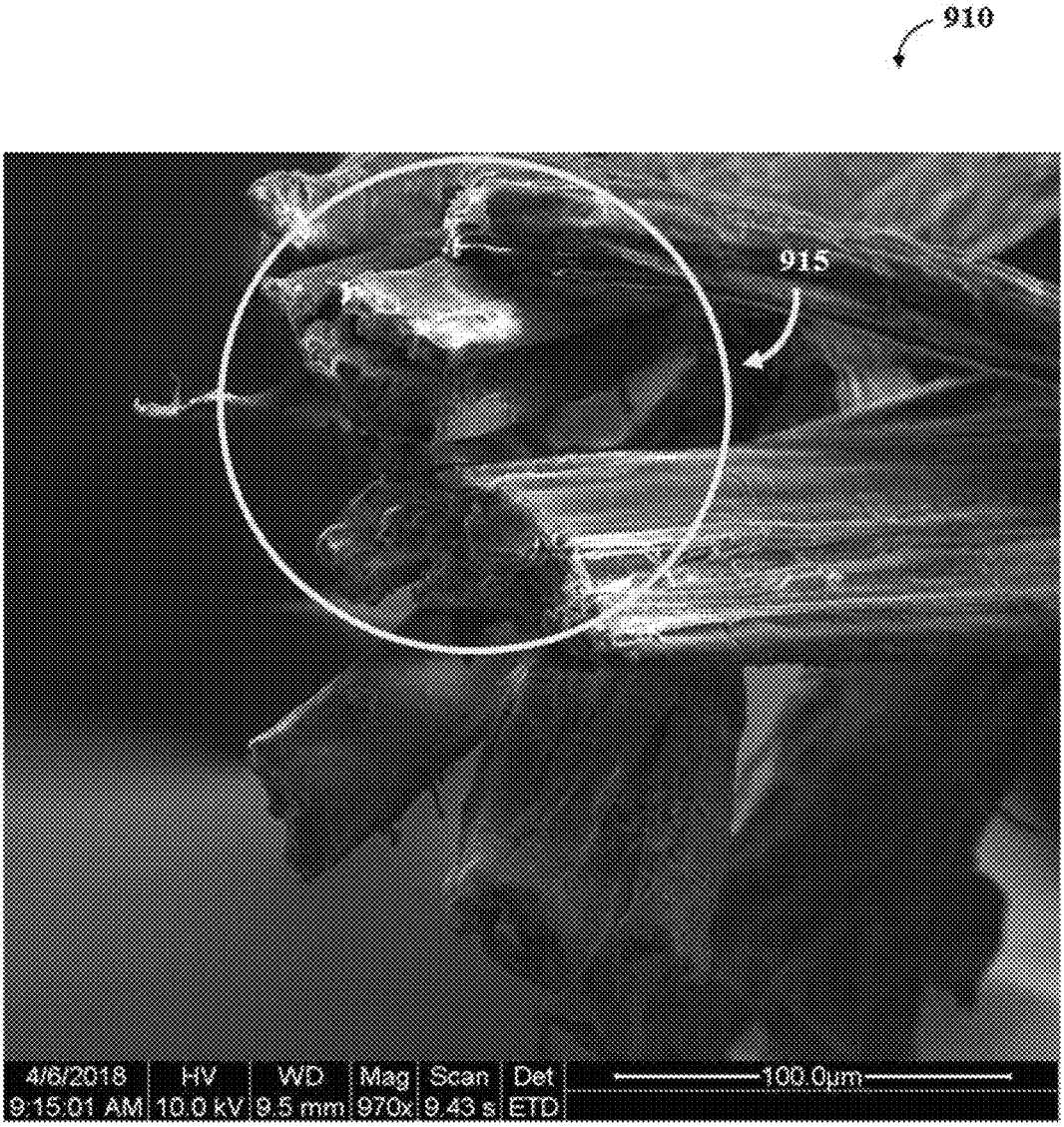
Figure 9C:
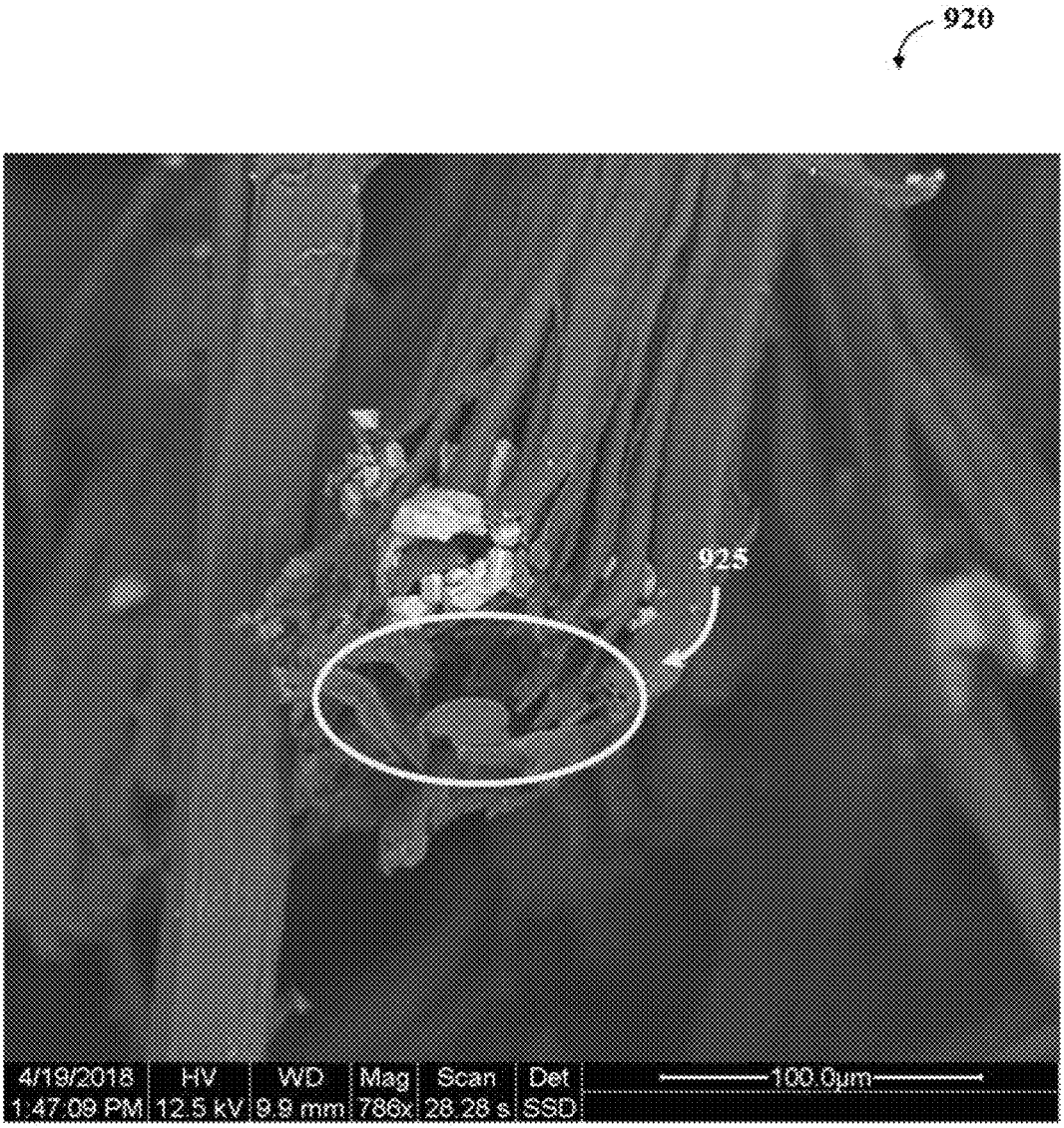

In some cases, preparing a solution of the fire retardant without heating the fire retardant or the fire retardant solution to a processing temperature (30° C. to about 80° C.) may not yield capping of the nanopores and/or micropores of the delignified industrial hemp with fire retardant crystals. As shown in FIGS. 9A and 9B, the SEM images 900 and 910 show that a treatment of the delignified industrial hemp with a solution of fire retardant (e.g., boric acid in water) that is prepared in room temperature does not yield the formation of fire retardant crystals on the industrial hemp, 905 and 915, respectively. In some cases, a concentration of the fire retardant that is soluble in the solvent (e.g., water) at room temperature may not be sufficient to provide crystallization of the fire retardant on the surface of the delignified industrial hemp. In some cases, as shown in FIG. 9C, a higher concentration of the fire retardant at a processing temperature that is higher than room temperature may not provide sufficient capping of the pores of the delignified industrial hemp, as shown in area 925 of the SEM image 920.

There may be additional methods of improving the application of the fire retardant to the delignified natural fiber. In some cases, the delignified fibers may be soaked in ethanol prior to adding the gel-like solution of the fire retardant. Such method may promote borate crystallization on the surface of delignified natural fiber. In some cases, the delignified natural fiber may be mechanically treated (e.g., via sheering) to increase surface area and/or porosity. Fracture sites (e.g., sheer sites) from such method may promote nucleation, crystallization and growth the crystals of the fire retardant.

While preferred embodiments of the present invention have been shown and described herein, it will be obvious to those skilled in the art that such embodiments are provided by way of example only. It is not intended that the invention be limited by the specific examples provided within the specification. While the invention has been described with reference to the aforementioned specification, the descriptions and illustrations of the embodiments herein are not meant to be construed in a limiting sense. Numerous variations, changes, and substitutions will now occur to those skilled in the art without departing from the invention. Furthermore, it shall be understood that all aspects of the invention are not limited to the specific depictions, configurations or relative proportions set forth herein which depend upon a variety of conditions and variables. It should be understood that various alternatives to the embodiments of the invention described herein may be employed in practicing the invention. It is therefore contemplated that the invention shall also cover any such alternatives, modifications, variations or equivalents. It is intended that the following claims define the scope of the invention and that methods and structures within the scope of these claims and their equivalents be covered thereby.

Creation of a Nonwoven Cellulosic Composite.

Nonwoven cellulosic webs are commonly referred to as batt forms of insulation, and are the primary type of insulation used in residential buildings.

The creation of this batt insulation includes all of the previously described processes, but has additional manufacturing steps and components. The primary difference between cellulose blow-in and a nonwoven web is the addition of a binding agent that allows the batt insulation to maintain its shape and loft.

Binders used in the invention can include common thermoplastics such as poly(lactic) acid (PLA) fiber, polysulfone, and polyester fiber. Bleaching of the fibers can enhance chemical and physical bonding of the binder and fire retardant due to increased surface area and surface roughness. The invention can also include the use of the family of PLA-Lignin copolymers including the varying number average and weight average molecular weights, degree of acetylation, end groups, functional groups, and growth methods. The use of PLA-Lignin copolymers can be an important component of the invention because the basis of the copolymer can be isolated from the waste stream of the bleaching process.

EMBODIMENTS

Embodiment 1

A method for chemically selectively depolymerizing cellulosic materials comprising:

- providing cellulosic precursor materials including supporting structures of lignocellulosic matter such as lignin and hemicellulose;
- separating bast fibers and hurd from the cellulosic precursor materials wherein the bast fibers and the hurd have crystal structures;
- creating a chemical pretreatment solution;
- placing the bast fibers and hurd fibers in the chemical pretreatment solution;

dissolving lignin, hemicellulose, and pectin anatomies from the bast fibers and hurd fibers with the chemical pretreatment solution but not depolymerizing cellulose; and covering at least portions of the bast fibers and hurd fibers with a flame-retardant layer.

Embodiment 2

The method of Embodiment 1 for creating the material's porosity is created in two ways or mechanisms, wherein:

the first is through the introduction of micro and nanopores where lignin and hemicellulose used to reside within the anatomical structure of the lignocellulosic material's anatomy. This is based on the idea that when a component of a given system is removed, ambient air or a gas will fill in the space where the component was previously situated in; and the second mechanism is through inducing separation of cellulose fibrils, by removing two or more supporting structures (lignin and hemicellulose) from the lignocellulosic system. The removal of the high lignin contents in the middle lamella region induces cellulose agglomeration, which causes receding between cell walls, which leads to an increase in porosity and surface area within the material.

Embodiment 3

The method of Embodiment 1, increases the material's thermal insulation properties or R-value, and acoustic insulation properties after the lignocellulosic lignin material is selectively depolymerized. Selective depolymerization includes removal of lignin, hemicellulose and pectin anatomies.

Embodiment 4

The method of Embodiment 1 wherein the thermal resistivity is between 2-6 Km^2/W after the lignocellulosic lignin material is selectively depolymerized. Selective depolymerization includes removal of lignin, hemicellulose and pectin anatomies.

Embodiment 5

The method of Embodiment 1 wherein the the cellulose precursor materials include at least one of: grasswoods, softwoods, hardwoods, and plants or bast fiber plant.

Embodiment 6

The method of Embodiment 1 wherein the cellulose precursor materials include recycled cellulose products.

Embodiment 7

The method of Embodiment 6 wherein the recycled cellulose products include at least one of: recycled newspaper, recycled denim, or recycled textiles.

Embodiment 8

The method of Embodiment 1 wherein less than 5% of the crystal structures of the bast fibers and the hurd are not damaged or altered [as determined by the crystallinity index (CI) or by percent crystallinity derivations from X-ray Diffraction, Thermal Gravimetric Analysis, Differential Scanning calorimetry instrumentation] by the chemical pretreatment solution.

Embodiment 9

The method of Embodiment 1 wherein a volumetric ratio of the bast fibers to the hurd is greater than 40%.

Embodiment 10

The method of Embodiment 1 further comprising: exposing the cellulose precursor materials to oxidizing mechanisms to selectively depolymerizing the cellulose precursor materials to isolate chemical byproducts as shown in Kraft process treatments.

Embodiment 11

The method of Embodiment 1 further comprising: exposing the cellulose precursor materials with ionic mechanisms with or without coordinating anions to selectively depolymerizing the cellulose precursor materials to isolate chemical byproducts as shown in ionic liquid treatments.

Embodiment 12

The method of Embodiment 1 results to micro and nanopores due to the treatment. It is further treated with fiberization techniques to create further macroscopic porosity and to create an overall lowered density between the range of 2.5-3.7 lb/ft$^3$. The result is a new insulating material with macropores, as well as micro and nanopores. Macropores are created through fiberization, while the micro and nanopores are created through the chemical treatment.

Embodiment 13

The method of Embodiment 1 wherein the materials that may be subjected to this treatment under the invention include, but are not limited to, grasswoods, softwoods, hardwoods, plants, and altered or recycled cellulose materials, and bast fiber plants.

Embodiment 14

The method of Embodiment 1 maintains crystal structure, through selective depolymerization of lignocellulosic mass which increases insulation performance, also allows for easier isolation of chemical byproducts due to milder oxidizing mechanisms experienced by the lignocellulosic components in the biomass. The selectivity described within the invention relies on strategically selecting oxidizers. Strong oxidizing agents used in previous inventions include concentrated alkali solvents such as sodium hydroxide and sodium sulfides. These chemical treatments are strong oxidizers and thus will oxidize not only the hemicellulose and lignin, but also the cellulose structure. The current embodiment of the invention strategically selects mild oxidizers to selectively remove lignin and hemicellulose. This is a twofold advantage in that is allows for the creation of the acoustic and thermal insulating closed cell pockets, but also allows for a simple extraction of the byproducts of the chemical treatment. Prior art has been focused on fully dissolving the entirety of the lignocellulosic anatomy, and has had issues in recovering the byproducts due to over oxidation. This requires extra time, chemical reaction steps, increased chemical intensity, and more energy to recover the dissolved byproducts.

Embodiment 15

The method of Embodiment 1 wherein the added fire retardants such as borate based and wood ash based fire retardants increase fire resistivity, fungal and bacterial infestation, and to increase thermal resistivity.

Embodiment 16

The method of Embodiment 1 where the additional layer of added fire retardants from claim 15 increase thermal and acoustic insulation performance by creating additional closed cells or semi-closed cells. This occurs by having the fire retardants block the surfaces where the micro and nanopores created may reside throughout the treated insulation material.

Embodiment 17

The method of Embodiment 1 wherein the acoustic insulating performance is also increased via closed cell induction caused by selective depolymerization.

Embodiment 18

The method of Embodiment 1 where the extraction of valuable byproducts is possible due to maintaining crystal structures, a result of not depolymerizing cellulose, but depolymerizing lignin, hemicellulose and pectin anatomies into structures that can be dissolved in the chemical pretreatment. The chemical solution comprising dissolved lignin, hemicellulose, and pectin derivatives can be further altered to extract these value added byproducts.

Embodiment 19

The method for physically selectively depolymerizing cellulosic materials comprising: providing cellulosic precursor materials including supporting structures of lignocellulosic matter such as lignin and hemicellulose; separating bast fibers and hurd from the cellulosic precursor materials wherein the bast fibers and the hurd have crystal structures; physically removing lignin, hemicellulose, and pectin anatomies from the bast fibers and the hurd with the chemical pretreatment solution, wherein the physically removing the lignin and hemicellulose is performed by: steam explosion, die extrusion or mechanical/alkaline fractionation; and covering at least portions of the bast fibers and hurd fibers with a flame-retardant layer.

Embodiment 20

The method of Embodiment 19 for creating the material's porosity is created in two ways or mechanisms. The first is through the introduction of micro and nanopores where lignin and hemicellulose used to reside within the anatomical structure of the lignocellulosic material's anatomy. This is based on the idea that when a component of a given system is removed, ambient air or a gas will fill in the space where the component was previously situated in. The second mechanism is through inducing separation of cellulose fibrils, by removing two or more supporting structures (lignin and hemicellulose) from the lignocellulosic system. The removal of the high lignin contents in the middle lamella region induces cellulose agglomeration, which causes receding between cell walls, which leads to an increase in porosity and surface area within the material.

Embodiment 21

The method of Embodiment 19, increases the material's thermal insulation properties or R-value, and acoustic insulation properties after the lignocellulosic lignin material is selectively depolymerized. Selective depolymerization includes removal of lignin, hemicellulose and pectin anatomies.

Embodiment 22

The method of Embodiment 19 wherein the thermal resistivity is between 2-6 Km^2/W after the lignocellulosic lignin material is selectively depolymerized. Selective depolymerization includes removal of lignin, hemicellulose and pectin anatomies.

Embodiment 23

The method of Embodiment 19 wherein the the cellulose precursor materials include at least one of: grasswoods, softwoods, hardwoods, and plants or bast fiber plant.

Embodiment 24

The method of Embodiment 19 wherein the cellulose precursor materials include recycled cellulose products.

Embodiment 25

The method of Embodiment 24 wherein the recycled cellulose products include at least one of: recycled newspaper, recycled denim, or recycled textiles.

Embodiment 26

The method of Embodiment 19 wherein less than 5% of the crystal structures of the bast fibers and the hurd are not damaged or altered [as determined by the crystallinity index (CI) or by percent crystallinity derivations from X-ray Diffraction, Thermal Gravimetric Analysis, Differential Scanning calorimetry instrumentation] by the chemical pretreatment solution.

Embodiment 27

The method of Embodiment 19 wherein a volumetric ratio of the bast fibers to the hurd is greater than 40%.

Embodiment 28

The method of Embodiment 19 further comprising: exposing the cellulose precursor materials to oxidizing mechanisms to selectively depolymerizing the cellulose precursor materials to isolate chemical byproducts as shown in Kraft process treatments.

Embodiment 29

The method of Embodiment 19 further comprising: exposing the cellulose precursor materials with ionic mechanisms with or without coordinating anions to selectively depolymerizing the cellulose precursor materials to isolate chemical byproducts as shown in ionic liquid treatments.

Embodiment 30

The method of Embodiment 19 results to micro and nanopores due to the treatment. It is further treated with fiberization techniques to create further macroscopic porosity and to create an overall lowered density between the range of 2.5-3.7 lb/ft$^3$. The result is a new insulating material with macropores, as well as micro and nanopores. Macropores are created through fiberization, while the micro and nanopores are created through the chemical treatment Embodiment 31

The method of Embodiment 19 wherein the materials that may be subjected to this treatment under the invention include, but are not limited to, grasswoods, softwoods, hardwoods, plants, and altered or recycled cellulose materials, and bast fiber plants.

Embodiment 32

The method of Embodiment 19 maintains crystal structure, through selective depolymerization of lignocellulosic mass which increases insulation performance, also allows for easier isolation of chemical byproducts due to milder oxidizing mechanisms experienced by the lignocellulosic components in the biomass. The selectivity described within the invention relies on strategically selecting oxidizers. Strong oxidizing agents used in previous inventions include concentrated alkali solvents such as sodium hydroxide and sodium sulfides. These chemical treatments are strong oxidizers and thus will oxidize not only the hemicellulose and lignin, but also the cellulose structure. The current embodiment of the invention strategically selects mild oxidizers to selectively remove lignin and hemicellulose. This is a two-fold advantage in that is allows for the creation of the acoustic and thermal insulating closed cell pockets, but also allows for a simple extraction of the byproducts of the chemical treatment. Prior art has been focused on fully dissolving the entirety of the lignocellulosic anatomy, and has had issues in recovering the byproducts due to over oxidation. This requires extra time, chemical reaction steps, increased chemical intensity, and more energy to recover the dissolved byproducts.

Embodiment 33

The method of Embodiment 19 wherein the added fire retardants such as borate based and wood ash based fire retardants increase fire resistivity, fungal and bacterial infestation, and to increase thermal resistivity.

Embodiment 34

The method of Embodiment 19 where the additional layer of added fire retardants from claim 16 increase thermal and acoustic insulation performance by creating additional closed cells or semi-closed cells. This occurs by having the fire retardants block the surfaces where the micro and nanopores created may reside throughout the treated insulation material.

Embodiment 35

The method of Embodiment 19 wherein the acoustic insulating performance is also increased via closed cell induction caused by selective depolymerization.

What is claimed is:

1. A method of making a composite building material, comprising:

(a) subjecting a cellulosic material to a pretreatment comprising a wet chemical process, such that said cellulosic material (i) is at least partially delignified, (ii) maintains at least a portion of cellulose crystal structure, and (iii) comprises a plurality of pores; and (b) adding a fire retardant to said cellulosic material such that (i) said fire retardant is distributed in and/or on said cellulosic material, and (ii) said fire retardant is present in an amount between about 5% and about 70% by weight of said composite building material, wherein a viscosity of said fire retardant ranges between about 10 centipoise (cP) and about 2000 cP, wherein said fire retardant comprises one or more members selected from the group consisting of magnesium oxides, magnesium silicate, and hydrated magnesium carbonate hydroxide, and wherein one or more of said plurality of pores are covered by said fire retardant.

2. The method of claim 1, wherein a thermal conductivity of said composite building material ranges between about 2 to 20 m2·K/W.

3. The method of claim 1, wherein said cellulosic material is derived from a natural fiber selected from a group consisting of a bast, leaf, seed, fruit, grass, and wood.

4. The method of claim 3, wherein a source of said natural fiber is selected group the group consisting of flax, hemp, kenaf, jute, ramie, isora, nettle, ananas, sisal, abaca, curua, cabuya, palm, opuntia, jipijapa, yucca, cotton, coir, kapok, soya, poplar, calotropis, luffa, bamboo, totora, hardwood, and softwood.

5. The method of claim 1, wherein said cellulosic material is a recycled cellulose product.

6. The method of claim 1, wherein said cellulosic material that is at least partially delignified has a Kappa number that is reduced as compared to said cellulosic material without any delignification.

7. The method of claim 1, wherein said pretreatment comprises selectively depolymerizing lignin, hemicellulose, and/or pectin of said cellulosic material.

8. The method of claim 1, wherein said cellulosic material maintains at least about 50% of said cellulose crystal structure.

9. The method of claim 1, further comprising assessing a degree of crystallinity of said at least said portion of said cellulose crystal structure by X-ray diffraction (XRD), differential scanning calorimetry (DSC), and thermogravimetric analysis (TGA).

10. The method of claim 1, further comprising assessing a presence of said plurality of pores of said cellulosic material is assessed by scanning electron microscopy (SEM).

11. The method of claim 1, wherein said plurality of pores of said cellulosic material are nanopores, and/or micropores.

12. The method of claim 1, wherein said plurality of pores of said cellulosic material have a cross-sectional width in a range between about 1 nanometer (nm) to about 1 millimeter (mm).

13. The method of claim 1, further comprising subjecting said cellulosic material to fiberization prior to and/or subsequent to delignification, wherein said fiberization creates one or more macropores that have a cross-sectional width greater than 1 mm.

14. The method of claim 1, wherein said fire retardant increases fungal and/or bacterial infestation of said cellulosic material.

15. The method of claim 1, wherein said fire retardant covers between about 10% and about 100% of said plurality of pores of said cellulosic material, thereby creating one or more closed cells.

16. The method of claim 1, wherein said fire retardant is present in an amount between about 10% and about 20% by weight.

17. The method of claim 1, wherein said fire retardant comprises two or more members selected from the group consisting of magnesium oxides, magnesium silicate, and hydrated magnesium carbonate hydroxide.

18. The method of claim 1, wherein said pretreatment comprises wetting said cellulosic material with a first liquid prior to adding said fire retardant, wherein said first liquid is introduced by spraying and/or steaming.

19. The method of claim 1, wherein said fire retardant is dispersed in a second liquid, further comprising adding said second liquid including said fire retardant to said cellulosic material.

20. The method of claim 1, further comprising adding a dye to change an apparent color of said composite building material.

21. The method of claim 1, wherein said viscosity of said fire retardant is at least about 100 cP.

22. The method of claim 1, wherein said viscosity of said fire retardant is at least about 1,000 cP.

23. The method of claim 1, wherein said fire retardant is present in an amount between about 6% and about 30% by weight.

* * * * *